US008747576B2

(12) United States Patent
Miyazaki et al.

(10) Patent No.: US 8,747,576 B2
(45) Date of Patent: Jun. 10, 2014

(54) PEARLITE-BASED HIGH CARBON STEEL RAIL HAVING EXCELLENT DUCTILITY AND PROCESS FOR PRODUCTION THEREOF

(75) Inventors: Teruhisa Miyazaki, Tokyo (JP); Masaharu Ueda, Tokyo (JP); Suguru Yoshida, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 22 days.

(21) Appl. No.: 13/261,069

(22) PCT Filed: Apr. 14, 2010

(86) PCT No.: PCT/JP2010/002708

§ 371 (c)(1), (2), (4) Date: Dec. 8, 2011

(87) PCT Pub. No.: WO2010/150448

PCT Pub. Date: Dec. 29, 2010

(65) Prior Publication Data

US 2012/0087825 A1 Apr. 12, 2012

(30) Foreign Application Priority Data

Jun. 26, 2009 (JP) ..... 2009-151774

(51) Int. Cl.

| | |
|---|---|
| ***C22C 38/12*** | (2006.01) |
| ***C22C 38/14*** | (2006.01) |
| ***C21D 7/13*** | (2006.01) |

(52) U.S. Cl.

USPC ..... 148/328; 148/320; 148/504; 148/507; 148/584; 148/648; 420/99; 420/126; 420/127; 420/128

(58) Field of Classification Search

CPC ..... C22C 38/14; C22C 38/12; C21D 7/13; C21D 2211/009; C21D 9/04

USPC ..... 148/584, 648–654, 320, 330–336, 328, 148/504, 507; 420/99, 126, 127, 128

See application file for complete search history.

(56) References Cited

U.S. PATENT DOCUMENTS

| | | | |
|---|---|---|---|
| 5,382,307 | A | 1/1995 | Kageyama et al. |
| 5,645,653 | A | 7/1997 | Jerath et al. |

(Continued)

FOREIGN PATENT DOCUMENTS

| | | |
|---|---|---|
| CA | 2734980 | 5/2010 |
| CA | 2752318 | 8/2010 |

(Continued)

OTHER PUBLICATIONS

Machine-English translation of Japanese patent 2000-178690, Ueda Masaharu et al., Jun. 27, 2000.*

(Continued)

*Primary Examiner* — Deborah Yee

(74) *Attorney, Agent, or Firm* — Kenyon & Kenyon LLP

(57) ABSTRACT

This high-carbon pearlitic steel rail having excellent ductility, includes: in terms of percent by mass, C: more than 0.85% to 1.40%; Si: 0.10% to 2.00%; Mn: 0.10% to 2.00%; Ti: 0.001% to 0.01%; V: 0.005% to 0.20%; and N: less than 0.0040%, with the balance being Fe and inevitable impurities, wherein contents of Ti and V fulfill the following formula (1), and a rail head portion has a pearlite structure.

$$5 \leq [V(\%\text{ by mass})]/[Ti(\%\text{ by mass})] \leq 20 \quad \text{Formula (1)}$$

16 Claims, 5 Drawing Sheets

(56) References Cited

U.S. PATENT DOCUMENTS

| | | | | |
|---|---|---|---|---|
| 5,762,723 | A | 6/1998 | Ueda et al. | |
| 6,254,696 | B1 | 7/2001 | Ueda et al. | |
| 7,217,329 | B2 | 5/2007 | Cordova | |
| 7,288,159 | B2 | 10/2007 | Cordova | |
| 7,416,622 | B2 | 8/2008 | Küppers et al. | |
| 7,608,154 | B2 | 10/2009 | O-hashi et al. | |
| 7,955,445 | B2 | 6/2011 | Honjo et al. | |
| 7,972,451 | B2 * | 7/2011 | Ueda et al. | 148/320 |
| 8,210,019 | B2 | 7/2012 | Ueda et al. | |
| 2004/0035507 | A1 | 2/2004 | Cordova | |
| 2004/0187981 | A1 | 9/2004 | Ueda et al. | |
| 2007/0181231 | A1 | 8/2007 | Ueda et al. | |
| 2008/0011393 | A1 | 1/2008 | Ueda et al. | |
| 2010/0116381 | A1 | 5/2010 | Honjo et al. | |
| 2011/0155821 | A1 | 6/2011 | Ueda et al. | |
| 2011/0226389 | A1 | 9/2011 | Ueda et al. | |
| 2011/0303756 | A1 | 12/2011 | Ueda et al. | |
| 2012/0087825 | A1 | 4/2012 | Miyazaki et al. | |

FOREIGN PATENT DOCUMENTS

| | | | |
|---|---|---|---|
| CN | 1522311 | | 8/2004 |
| CN | 1793402 | | 6/2006 |
| CN | 1884606 | | 12/2006 |
| EP | 0754775 | | 1/1997 |
| EP | 0770695 | | 5/1997 |
| JP | 46-021090 | | 6/1971 |
| JP | 52-101624 | | 8/1977 |
| JP | 63-128123 | | 5/1988 |
| JP | 05-171247 | | 7/1993 |
| JP | 05-263121 | | 10/1993 |
| JP | 06-279928 | | 10/1994 |
| JP | 07-173530 | | 7/1995 |
| JP | 08-104946 | | 4/1996 |
| JP | 08-246100 | | 9/1996 |
| JP | 09-111352 | | 4/1997 |
| JP | 2000-226636 | | 8/2000 |
| JP | 2000-345296 | | 12/2000 |
| JP | 2001-020040 | | 1/2001 |
| JP | 2001-220651 | | 8/2001 |
| JP | 2001-234238 | | 8/2001 |
| JP | 2002-226915 | * | 8/2002 |
| JP | 2002-302737 | | 10/2002 |
| JP | 2002-363696 | | 12/2002 |
| JP | 2002-363702 | | 12/2002 |
| JP | 2003-105499 | | 4/2003 |
| JP | 2003-129180 | | 5/2003 |
| JP | 2004-043865 | | 2/2004 |
| JP | 2004-043963 | | 2/2004 |
| JP | 2004-076112 | | 3/2004 |
| JP | 2005-256023 | | 9/2005 |
| JP | 2005-350723 | | 12/2005 |
| JP | 2006-111939 | | 4/2006 |
| JP | 2007-169727 | | 7/2007 |
| JP | 2007-291413 | | 11/2007 |
| JP | 2008-013811 | | 1/2008 |
| JP | 2008-050684 | | 3/2008 |
| RU | 2107740 | | 3/1998 |
| RU | 2136767 | | 9/1999 |
| RU | 2194791 | | 12/2002 |
| RU | 2259416 | | 8/2005 |
| RU | 2295587 | | 3/2007 |
| SU | 720047 | | 3/1980 |

OTHER PUBLICATIONS

International Search Report dated Jun. 29, 2010 issued in corresponding PCT Application PCT/JP/2010/002708.

JIS E 1101-1990 (with English Abstract).

Canadian Office Action, dated Nov. 16, 2012, issued in corresponding Canadian Application No. 2764769.

Canadian Office Action, dated Oct. 25, 2012, issued in Canadian Application No. 2734980, which corresponds to U.S. Appl. No. 13/061,001.

International Search Report dated Feb. 2, 2010, issued in corresponding PCT Application No. PCT/JP2009/005800 and corresponding to U.S. Appl. No. 13/061,001.

International Search Report dated Mar. 23, 2010, issued in corresponding PCT Application No. PCT/JP2010/000339 and corresponding to U.S. Appl. No. 13/201,573.

Russian Decision on Grant dated Apr. 3, 2012, issued in Russian Application No. 2011110256 and corresponding to U.S. Appl. No. 13/061,001, and an English translation thereof.

European Search Report dated Jun. 26, 2012, issued in corresponding European Application No. 10743487.0 and corresponding to U.S. Appl. No. 13/201,573.

U.S. Office Action dated Nov. 26, 2012, issued in related U.S. Appl. No. 13/201,573.

Russian Notice of Allowance, dated Feb. 15, 2013, issued in corresponding Russian application No. 2011152194, and an English translation thereof.

Russian Notice of Allowance, dated Jan. 16, 2013, issued in corresponding Russian application No. 2011131245, and an English translation thereof.

* cited by examiner

PEARLITE-BASED HIGH CARBON STEEL RAIL HAVING EXCELLENT DUCTILITY AND PROCESS FOR PRODUCTION THEREOF

This application is a national stage application of International Application No. PCT/JP2010/002708, filed Apr. 14, 2010, which claims priority to Japanese Patent Application No. 2009-151774 filed Jun. 26, 2009, the content of which is incorporated herein by reference.

TECHNICAL FIELD

The present invention relates to a high-carbon pearlitic steel rail (pearlite-based high carbon steel rail) designed to have improved ductility in the field of rails that are used in heavy haul railways and the like, and a method for manufacturing the same.

BACKGROUND ART

A high-carbon pearlitic steel has been used as a rail material of a railroad due to its excellent abrasion-resistant. However, there has been a problem in that the ductility or toughness is low since the content of carbon is extremely high.

For example, with regard to an ordinary carbon steel rail containing carbon at an amount of 0.6 to 0.7% by mass as shown in Non-Patent Document 1, the impact value at room temperature is in a range of about 12 to 18 J/cm$^2$ which is measured by Charpy impact testing of JIS No. 3 U-notch specimen. In the case where this ordinary carbon steel rail is used in a low-temperature region, such as a cold weather region, there has been a problem in that brittle fractures occur due to fine initial defects or fatigue cracking.

In addition, the carbon amount in a rail steel has been further increased in order to improve the wear resistance in recent years; and therefore, there has been a problem in that the ductility and the toughness are further degraded due to the increased carbon amount.

It is generally known that refinement of pearlite structure (pearlite block size) which is specifically, refinement of austenite grains before pearlite transformation or refinement of the pearlite structure during pearlite transformation is effective for improving the ductility and the toughness of pearlitic steels.

Examples of a method of refining the austenite grains include lowering of the reheating temperature during reheating of a bloom for rail rolling, lowering of the rolling temperature during hot rolling, and increasing of the reduction of cross-sectional area during hot rolling.

However, in a process of manufacturing a rail, there is a problem in that, even in the case where the refinement of the austenite grains immediately after rolling can be achieved by the above-mentioned method, the grains grow until a thermal treatment starts; and consequently, the ductility is degraded.

In addition, transformation acceleration from the inside of austenite grains is carried out by utilizing transformation nuclei in order to achieve the refinement of the pearlite structure during pearlite transformation (for example, Patent Document 1).

However, with regard to the pearlite transformation from the inside of austenite grains by utilizing transformation nuclei, there are problems in that it is difficult to control the amount of transformation nuclei, and the pearlite transformation from the inside of the grains is not stable. As a result, sufficient refinement of the pearlite structure may not be achieved.

In view of the above-mentioned various problems, a method of refining pearlite structure has been applied in order to fundamentally improve the ductility and the toughness of rails having pearlite structure, and this method includes: reheating at low temperatures after rolling of a rail; and performing accelerated cooling thereafter to conduct pearlite transformation; and thereby, the pearlite structure is refined (for example, Patent Document 2).

However, the carbon amount in a rail has been increased in order to improve the wear resistance in recent years. Therefore, there has been a problem in that coarse carbides are not completely melted and remain in austenite grains during the above-mentioned reheating treatment at low temperatures; and thereby, the ductility and the toughness of the pearlite structure after the accelerated cooling are degraded. In addition, since this method includes reheating, there has been a problem of economic efficiencies, such as high manufacturing costs, low productivity, and the like.

In view of these circumstances, a pearlitic rail having improved ductility and a production method thereof were developed (Patent Documents 3 and 4). In the pearlitic rail, pinning effect due to precipitates is utilized; and thereby, the growth of austenite grains is suppressed, and pearlite blocks are refined. As a result, the ductility is improved.

However, in the case of the pearlitic rail and the production method thereof according to Patent Documents 3 and 4, it is necessary to perform reheating at low temperatures in order to finely disperse AlN; and therefore, there are problems in that it is difficult to secure the rolling formability, and the ductility is degraded due to generation of pro-eutectoid cementite in the inner of the head portion.

PRIOR ART DOCUMENT

Patent Document

Patent Document 1: Japanese Unexamined Patent Application, First Publication No. H06-279928

Patent Document 2: Japanese Unexamined Patent Application, First Publication No. S63-128123

Patent Document 3: Japanese Unexamined Patent Application, First Publication No. 2002-302737

Patent Document 4: Japanese Unexamined Patent Application, First Publication No. 2004-76112

Non-Patent Document

Non-Patent Document 1: JIS E 1101-1990

DISCLOSURE OF THE INVENTION

Problems to be Solved by the Invention

In order to solve the problem in that the ductility of the high-carbon steel rail is degraded, the present invention aims to provide a high-carbon pearlitic steel rail having improved ductility that is obtained by a method in which Ti-based precipitates (TiC, TiN, Ti(C, N)), V-based precipitates (VC, VN, V(C, N)) or Ti—V combined precipitates are finely precipitated in austenite during hot rolling, and thereby, the growth of austenite grains after rolling is suppressed until a thermal treatment, and the pearlite block size is refined so as to improve the ductility.

Means for Solving the Problems

The present invention is accomplished to achieve the above-mentioned object, and the features thereof are as follow.

(1) A high-carbon pearlitic steel rail having excellent ductility, includes: in terms of percent by mass, C: more than 0.85% to 1.40%; Si: 0.10% to 2.00%; Mn: 0.10% to 2.00%; Ti: 0.001% to 0.01%; V: 0.005% to 0.20%; and N: less than 0.0040%, with the balance being Fe and inevitable impurities. Contents of Ti and V fulfill the following formula (1), and a rail head portion has a pearlite structure.

$$5 \leq [V(\%\text{ by mass})]/[Ti(\%\text{ by mass})] \leq 20 \quad \text{Formula (1)}$$

(2) A method for manufacturing a pearlitic rail having excellent ductility, includes: subjecting a bloom to hot rolling. The bloom contains: in terms of percent by mass, C: more than 0.85% to 1.40%, Si: 0.10% to 2.00%, Mn: 0.10% to 2.00%, Ti: 0.001% to 0.01%, V: 0.005% to 0.20%, and N: less than 0.0040% with the balance being Fe and inevitable impurities. Contents of Ti and V fulfill the following formula (1). Finishing rolling of the hot rolling is carried out under conditions where a finishing rolling temperature (FT, ° C.) is set to be in a range represented by the following formula (3) with respect to a value ($T_c$) represented by the following formula (2) that includes a content of C ([C], % by mass), a content of V ([V], % by mass), and a content of Ti ([Ti], % by mass) of the bloom.

$$5 \leq [V(\%\text{ by mass})]/[Ti(\%\text{ by mass})] \leq 20 \quad \text{Formula (1)}$$

$$T_c = 850 + 35 \times [C] + 1.35 \times 10^4 \times [Ti] + 180 \times [V] \quad \text{Formula (2)}$$

$$T_c - 25 \leq FT \leq T_c + 25 \quad \text{Formula (3)}$$

(3) In the method of manufacturing a pearlitic rail having excellent ductility according to (2), the finishing rolling may be carried out under conditions where a sum (FR, %) of reductions of cross-sectional area in last two passes is set to be in a range represented by the following formula (5) with respect to a value ($R_c$) represented by the following formula (4) that includes a content of C ([C], % by mass), a content of V ([V], % by mass), and a content of Ti ([Ti], % by mass) of the bloom.

$$R_c = 35 - 13 \times [C] - 600 \times [Ti] - 20 \times [V] \quad \text{Formula (4)}$$

$$R_c - 5 \leq FR \leq R_c + 5 \quad \text{Formula (5)}$$

Effects of the Invention

In accordance with the present invention, with regard to a high-carbon steel rail having a pearlite structure which is used for heavy haul railways, a Ti amount, a V amount, and a N amount are adjusted in appropriate ranges, and Ti-based precipitates (TiC, TiN, Ti(C, N)), V-based precipitates (VC, VN, V(C, N)) or Ti—V combined precipitates are finely precipitated during hot rolling. Thereby, grain growth of austenite is suppressed between passes in a final finish rolling process and after the final finishing rolling process; and thereby, a fine pearlite structure is obtained. As a result, the ductility of the high carbon steel rail is improved; and thereby, it is possible to improve usable period (service life).

BEST MODE FOR CARRYING OUT THE INVENTION

Figure 1:
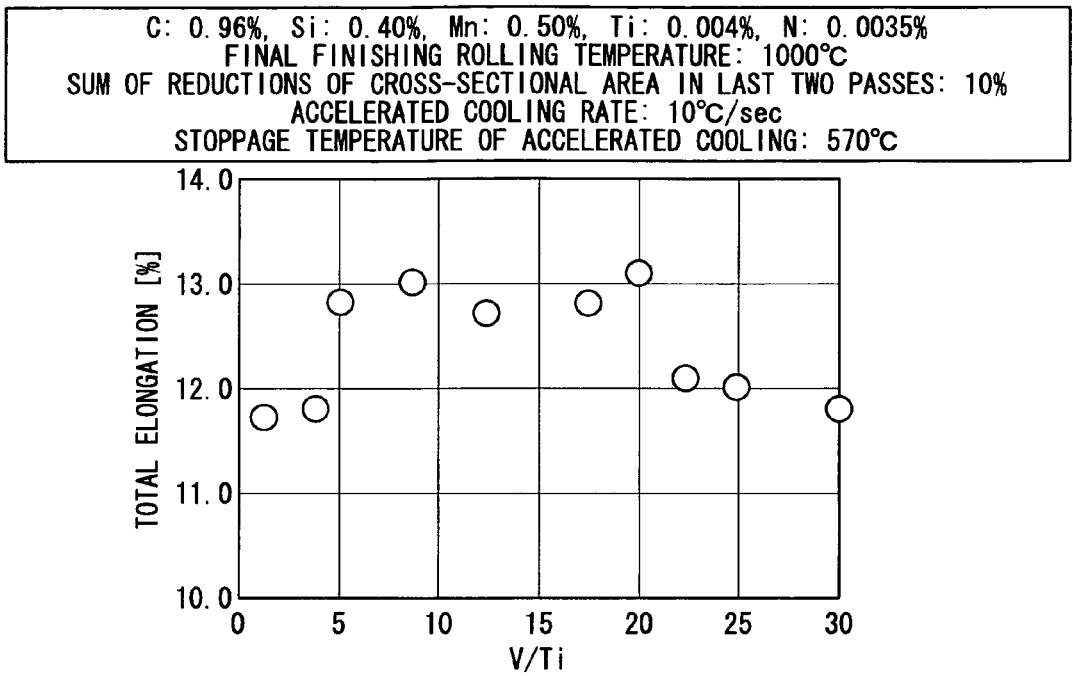
FIG. 1 is a view showing the relationship between V/Ti and the total elongation in tensile test results of hot-rolled materials obtained using blooms prepared by varying a V amount in a range of 0.005 to 0.12% in terms of percent by mass while keeping C: 0.96%, Si: 0.40%, Mn: 0.50%, Ti: 0.004%, and N: 0.0035%.

Hereinafter, the present invention will be described in detail.

(1) Reasons why the Chemical Compositions of a Rail Steel and a Bloom for Hot Rolling are Limited Firstly, the reasons why the chemical composition of the rail steel is limited to the claimed range will be described in detail. In the following description, the unit of the concentration of the composition is % by mass, and the concentration will be denoted simply as '%'.

C is an effective element for accelerating pearlite transformation and securing wear resistance. In the case where the C amount is 0.85% or less, the volume fraction of cementite phase in a pearlite structure cannot be secured; and thereby, the wear resistance cannot be maintained in heavy haul railways. In addition, in the case where the C amount exceeds 1.40%, the grain growth is not suppressed and generation of pro-eutectoid cementite becomes remarkable, even in the case where the manufacturing method of the present invention is applied. Thereby, coarse Ti carbides are further formed; and as a result, the ductility is degraded. Therefore, the C amount is set to be in a range of more than 0.85% to 1.40%. Meanwhile, in the case where the carbon amount is set to be 0.95% or more, the wear resistance is further improved, and the effect of improving the service life of rails becomes high.

Si is an essential component as a deoxidizing material. In addition, Si is an element that improves the hardness (strength) of a rail head portion by solid-solution strengthening in ferrite phase in a pearlite structure. Furthermore, Si is an element that suppresses generation of a pro-eutectoid cementite structure in hypereutectoid steel; and thereby, degradation of the ductility is suppressed. However, in the case where the Si amount is less than 0.10%, the effects cannot be sufficiently expected. In addition, in the case where the Si amount exceeds 2.00%, the ductility of the ferrite phase is degraded, and the ductility of the rail is not improved. Therefore, the Si amount is set to be in a range of 0.10% to 2.00%. Meanwhile, the effect of suppressing pro-eutectoid cementite becomes higher in the case where the Si amount is 0.3% or more.

Mn is an element that increases hardenability, lowers the pearlite transformation temperature, and refines pearlite lamellar spacing. Thereby, an increase in the hardness of a rail head portion is achieved, and, simultaneously, generation of a pro-eutectoid cementite structure is suppressed. However, in the case where the Mn amount is less than 0.10%, these effects become small, and, in the case where the Mn amount exceeds 2.00%, hardenability increases remarkably, and a martensite structure is easy to generate that is harmful to ductility. In addition, segregation is facilitated; and thereby, pro-eutectoid cementite that is harmful to the ductility of rails becomes easy to generate in segregated portions. As a result, the ductility is degraded. Therefore, the Mn amount is set to be in a range of 0.10% to 2.00%. Meanwhile, the effect of refining the lamellar spacing of pearlite becomes higher in the case where the Mn amount is 0.3% or more.

When Ti is added at a small amount to a steel, Ti is precipitated as fine TiC, TiN, and Ti(C,N) or precipitated in combination with V at dislocations introduced to austenite during hot rolling or at austenite grain boundaries. Therefore, Ti is an effective element for suppressing the grain growth of austenite grains after recrystallization, achieving the refinement of an austenite structure, and improving the ductility of a rail steel. However, in the case where the Ti amount is less than 0.001%, the effects cannot be sufficiently expected, and improvement in ductility due to austenite refinement is not observed. In addition, in the case where the Ti amount exceeds 0.01%, the temperature at which precipitates generate becomes higher than the temperature range in which V-based precipitates generate; and thereby, combined precipitation (precipitation of Ti in combination with V) becomes impossible to occur. Therefore, the Ti amount is set to be in a range of 0.001% to 0.01%.

In the case where the Ti amount is 0.003% or more, generation of precipitates in austenite can be stabilized in a hot rolling process. In addition, in the case where the Ti amount exceeds 0.008%, the number of precipitates generated in austenite is increased. However, the generation temperature is shifted to higher temperatures in accordance with an increase in the Ti amount; and therefore, precipitates in austenite become coarse. As a result, the pinning effect is saturated. Therefore, the preferable range of the Ti amount is 0.003% to 0.008%.

V is precipitated as fine VC, VN, and V(C,N) or precipitated in combination with Ti at dislocations introduced to austenite during hot rolling or at austenite grain boundaries. Therefore, V is an effective element for suppressing the grain growth of austenite grains after recrystallization, achieving the refinement of an austenite structure, and improving the ductility of a rail steel. However, in the case where the V amount is less than 0.005%, the effects cannot be expected, and improvement in ductility due to the pearlite structure is not observed. In addition, in the case where the V amount exceeds 0.20%, coarse V carbides and V nitrides are generated; and thereby, the grain growth of austenite grains cannot be suppressed. As a result, the ductility of a rail steel is degraded. Therefore, the V amount is set to be in a range of 0.005% to 0.20%.

In the case where the V amount is 0.02% or more, generation of precipitates in austenite can be stabilized in a hot rolling process. In addition, in the case where the V amount exceeds 0.15%, the total number of precipitates is increased. However, the generation temperature is shifted to higher temperatures; and therefore, precipitates in austenite become coarse. As a result, the pinning effect is saturated. Therefore, the preferable range of the V amount is 0.02% to 0.15%.

N is not an element to be forcibly added. However, in the case where 0.0040% or more of N is included, most of the Ti becomes coarse TiN in a molten steel; and thereby, N is not solid-solubilized in austenite in a reheating step during hot rolling. As a result, it becomes impossible to generate fine Ti-based precipitates (TiC, TiN, Ti(C,N)) or combined precipitates of Ti and V for suppressing the grain growth of austenite during hot rolling and immediately after hot rolling. Therefore, the N amount is set to be in a range of less than 0.0040%. Furthermore, the temperature at which Ti-based precipitates generate increases remarkably as the N amount is increased. Therefore, it is preferable to adjust the N amount in a range of less than 0.0030% in order to generate the precipitates in the temperature range in which V-based precipitates generate.

(2) Reasons why the Range of the Ratio of the Added Amounts of Ti to V (V/Ti) is Limited:

Reasons why the ratio of the contents of Ti and V in a steel in the present invention is set to be in the range represented by the following formula (1) will be described.

$$5 \leq [V(\%\text{ by mass})]/[Ti(\%\text{ by mass})] \leq 20 \qquad \text{Formula (1)}$$

<Experiment 1>

Firstly, the inventors manufactured blooms for rail rolling containing, in terms pf % by mass, C: 0.96%, Si: 0.40%, Mn: 0.50%, Ti: 0.004%, and N: 0.0035%, and further containing V at various amounts in a range of 0.005% to 0.12% with the balance composed of Fe and inevitable impurities. These blooms were reheated and held at 1250° C. for 60 minutes, and then hot rolling was carried out under conditions where the final finishing rolling temperature was 1000° C. and a sum of reductions of cross-sectional area in the last two passes was 10%. Next, after the completion of the hot rolling, accelerated cooling was carried out at a cooling rate of 10° C./sec from 780° C. which was within an austenite region to 570° C. Thereby, hot-rolled materials were manufactured. Test specimens were manufactured from the hot-rolled materials, and tensile tests were carried out. The obtained results are shown in FIG. 1. As shown in FIG. 1, it was found out that the total elongation is improved in a specific range of the V/Ti ratio when the relationship between the ratio V/Ti of the Ti amount to the V amount and the total elongation is arranged.

<Experiment 2>

Figure 2:
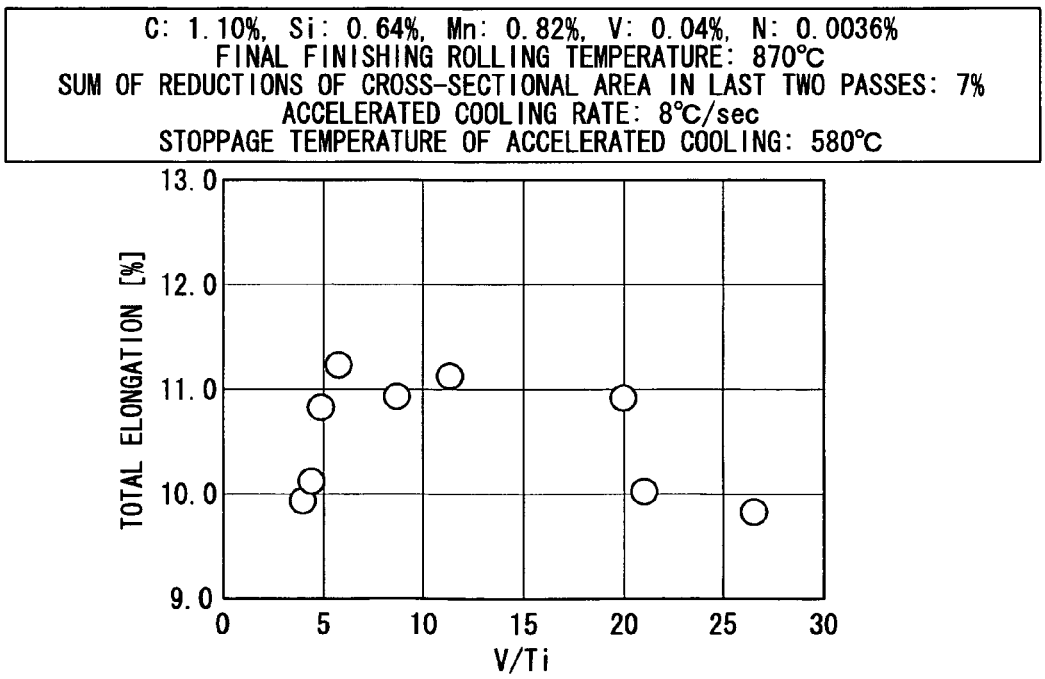
FIG. 2 is a view showing the relationship between V/Ti and the total elongation in the tensile test results of hot-rolled materials obtained using blooms prepared by varying a Ti amount in a range of 0.0015 to 0.01% in terms of percent by mass while keeping C: 1.10%, Si: 0.64%, Mn: 0.82%, V: 0.04%, and N: 0.0036%.

Next, blooms for rail rolling were manufactured which contained C: 1.10%, Si: 0.64%, Mn: 0.82%, V: 0.04%, and N: 0.0036%, and further contained Ti at various amounts in a range of 0.0015% to 0.01% with the balance composed of Fe and inevitable impurities. These blooms were reheated and held at 1280° C. for 70 minutes, and then hot rolling was carried out under conditions where the final finishing rolling temperature was 870° C. and a sum of reductions of cross-sectional area in the last two passes was 7%. Next, after the completion of the hot rolling, accelerated cooling was carried out at a cooling rate of 8° C./sec from 770° C. which was within an austenite region to 580° C. Thereby, hot-rolled materials were manufactured. Test specimens were manufactured from the hot-rolled materials, and tensile tests were carried out. The obtained results are shown in FIG. 2. As shown in FIG. 2, it was found out that the total elongation is improved in a specific range of the V/Ti ratio when the relationship between the ratio V/Ti of the Ti amount to the V amount and the total elongation is arranged.

From these results, it was found out that the total elongation is improved in the case where the V/Ti value is in a range of 5 to 20, compared with the total elongation in the case where the V/Ti value is outside the range. Specifically, the total elongation is improved by 5% or more adjusting the V/Ti value in a range of 5 to 20.

As a result of investigating the dispersion state of precipitates in the hot-rolled materials in detail, it was found that larger numbers of Ti-based precipitates and V-based precipitates were present in the materials having the V/Ti value in a range of 5 to 20 than those in the materials having the V/Ti value outside the range. As a result of investigating the generation behaviors of the Ti-based precipitates and the V-based precipitates in the hot-rolled materials, it was found that the generation temperatures of the Ti-based precipitates and the V-based precipitates were almost in the same temperature range in the materials having the V/Ti value in a range of 5 to 20. From these results, it is considered that both of the Ti-based precipitates and the V-based precipitates are dispersed finely at large amounts by utilizing dislocations introduced to austenite as precipitation sites during the final finishing rolling. It is considered that a difference between the generation temperature of the Ti-based precipitates and the generation temperature of the V-based precipitates occurs in the material having the V/Ti value outside the range of 5 to 20, and either of the Ti-based precipitates or the V-based precipitates cannot be dispersed finely at large amounts by utilizing dislocations introduced to austenite as precipitation sites during the final finishing rolling. In the case where the V/Ti value is in a range of 9 to 15, the generation temperature of the Ti-based precipitates and the generation temperature of the V-based precipitates approach to each other in comparison to cases in which the V/Ti value is outside the range. Thereby, generation of the Ti-based precipitates, the V-based precipitates, and Ti—V combined precipitates is stabilized.

Meanwhile, with regard to the chemical compositions of the blooms for hot rolling in the present invention, components other than C, Si, Mn, Ti, V, and N are not particularly limited; however, it is possible to further contain one or more of Nb, Cr, Mo, B, Co, Cu, Ni, Mg, Ca, Al, and Zr as necessary. Hereinafter, the reasons why the component ranges are limited will be described.

Nb suppresses the grain growth of austenite grains after recrystallization by Nb carbides and Nib carbonitrides which are precipitated by hot rolling. In addition, Nb is an effective element for increasing the ductility of the pearlite structure and improving the strength by the precipitation strengthening due to Nb carbides and Nb carbonitrides which are precipitated in a ferrite phase in the pearlite structure during a thermal treatment process after hot rolling. In addition, Nb is an element that stably generates carbides and carbonitrides during reheating and prevents the softening of the heat affected zones of welded joints. However, the effect cannot be expected in the case where the Nb amount is less than 0.002%, and improvement in the hardness of the pearlite structure and improvement in the ductility are not observed. In addition, in the case where more than 0.050% of Nb is added, coarse Nb carbides and coarse Nb carbonitrides are generated; and thereby, the ductility of a rail steel is degraded. Therefore, the content of Nb is preferably set to be in a range of 0.002% to 0.050%.

Cr is an element that increases the equilibrium transformation point of pearlite; and thereby, a pearlite structure is refined. As a result, Cr contributes to an increase in hardness (strength). At the same time, Cr strengthens a cementite phase; and thereby, the hardness (strength) of the pearlites structure is improved. As a result, Cr improves the wear resistance. However, in the case where the Cr amount is less than 0.05%, the effects are small. In the case where Cr is excessively added, exceeding 2.00%, the hardenability increases remarkably, and a large amount of martensite structure is generated; and thereby, the ductility of a rail steel is degraded. Therefore, the content of Cr is preferably in a range of 0.05% to 2.00%.

Similarly to Cr, Mo is an element that increases the equilibrium transformation point of pearlite; and thereby, a pearlite structure is refined. As a result, Mo contributes to an increase in hardness (strength), and Mo improves the hardness (strength) of the pearlite structure. However, in the case where the Mo amount is less than 0.01%, the effects are small, and the effect of improving the hardness of a rail steel is not observed. In addition, in the case where Mo is excessively added, exceeding 0.50%, the transformation rate of the pearlite structure is remarkably decreased; and thereby, a martensite structure is easy to generate that is harmful to the ductility of a rail steel. Therefore, the content of Mo is preferably in a range of 0.01% to 0.50%.

B forms iron borocarbides at prior-austenite grain boundaries and refines the generation of a pro-eutectoid cementite structure. At the same time, B is an element that lowers the dependency of the pearlite transformation temperature on the cooling rate; and thereby, the hardness distribution in the head portion is homogenized. As a result B prevents the degradation of the ductility of rails; and thereby, the service life can be extended. However, in the case where the B amount is less than 0.0001%, the effects are not sufficient, and improvement in the generation of a pro-eutectoid cementite structure or the hardness distribution in the rail head portion is not observed. In addition, in the case where more than 0.0050% of B is added, coarse iron borocarbides are generated at the prior-austenite grain boundaries, and the ductility and the toughness of a rail steel are remarkably degraded. Therefore, the content of B is preferably set to be in a range of 0.0001% to 0.0050%.

Co is solid-solubilized in ferrite in a pearlite structure; and thereby, Co improves the hardness (strength) of the pearlite structure due to solid solution strengthening. Furthermore, Co is an element that increases the transformation energy of pearlite and refines the pearlite structure; and thereby, the ductility is improved. However, in the case where the Co amount is less than 0.10%, the effects cannot be expected. In addition, in the case where more than 2.00% of Co is added, the ductility of the ferrite phase in the pearlite structure is remarkably degraded; and thereby, the ductility of a rail steel is remarkably degraded. Therefore, the content of Co is preferably set to be in a range of 0.10% to 2.00%.

Cu is solid-solubilized in ferrite in a pearlite structure; and thereby, Cu improves the hardness (strength) of the pearlite structure due to solid solution strengthening. However, in the case where the Cu amount is less than 0.05%, the effects cannot be expected. In addition, in the case where more than 1.00% of Cu is added, the hardenability is remarkably improved; and thereby, a martensite structure is easy to generate that is harmful to the wear resistance of a rail head portion and the ductility of a rail steel. Furthermore, the ductility of the ferrite phase in the pearlite structure is remarkably degraded; and thereby, ductility of rail steel is degraded. Therefore, the content of Cu is preferably set to be in a range of 0.05% to 1.00%.

Ni is an element that prevents embrittlement during hot rolling due to the addition of Cu, and, at the same time, Ni achieves an increase in the hardness (strength) of pearlitic steel due to solid solution strengthening into ferrite. However, in the case where the Ni amount is less than 0.01%, the effects are extremely small. In addition, in the case where more than 1.00% of Ni is added, the ductility of the ferrite phase in the pearlite structure is remarkably degraded; and thereby, the ductility of a rail steel is degraded. Therefore, the content of Ni is preferably set to be in a range of 0.01% to 1.00%.

Mg is an element that combines with O, S, Al, and the like to form fine oxides and sulfides; and thereby, Mg suppresses the grain growth of crystal grains and Mg achieves the refinement of austenite grains in the reheating process during hot rolling. As a result, Mg is an effective element to improve the ductility of the pearlite structure. Furthermore, MgO and MgS finely disperse MnS; and thereby, Mn-depleted zones are formed around MnS. This contributes to generation of pearlite transformation. As a result, since Mg miniaturizes the sizes of pearlite blocks, Mg is an effective element for improving the ductility of a pearlite structure. However, in the case where the Mg amount is less than 0.0005%, the effect is weak. In the case where more than 0.020% of Mg is added, the coarse oxides of Mg are generated; and thereby, the ductility of a rail steel is degraded. Therefore, the content of Mg is preferably set to be in a range of 0.0005% to 0.0200%.

Ca has a strong bonding force with S, and forms sulfides in the form of CaS. Furthermore, CaS finely disperses MnS; and thereby, Mn-depleted zones are formed around MnS. This contributes to generation of pearlite transformation. As a result, since Ca miniaturizes the sizes of pearlite blocks, Ca is an effective element for improving the ductility of the pearlite structure. However, in the case where the Ca amount is less than 0.0005%, the effect is weak. In the case where more than 0.0150% of Ca is added, the coarse oxides of Ca are generated; and thereby, the ductility of a rail steel is degraded. Therefore, the content of Ca is preferably set to be in a range of 0.0005% to 0.0150%.

Al is a useful component as a deoxidizing agent. In addition, Al is an element that raises the eutectoid transformation temperature to a higher temperature; and therefore, Al is an effective element for increasing the strength of the pearlite structure and preventing the generation of a pro-eutectoid cementite structure. However, in the case where the Al amount is less than 0.0050%, the effects are weak. In the case where more than 1.00% of Al is added, it becomes difficult to solid-solubilize Al in a steel; and thereby, coarse alumina-based inclusions are generated which act as starting points of fatigue damage. As a result, the ductility of a rail steel is degraded, and in addition, oxides are generated during welding; and thereby, weldability is remarkably degraded. Therefore, the content of Al is preferably in a range of 0.0050% to 1.00%.

Since $ZrO_2$ inclusions have a good lattice consistency with austenite, $ZrO_2$ inclusions acts as solidification nuclei in a high-carbon rail steel of which the primary crystal in a solidification process is austenite. Thereby, the equiaxial crystallization ratio of solidified structures is increased. As a result, Zr is an element that suppresses the formation of segregation zones in the middle of a casting bloom and suppresses the generation of a pro-eutectoid cementite structure which is to be generated in rail segregation portions. However, in the case where the Zr amount is less than 0.0001%, the number of $ZrO_2$-based inclusions is small; and therefore, the $ZrO_2$-based inclusions do not sufficiently act as solidification nuclei. As a result, a pro-eutectoid cementite structure is generated in segregation portions; and thereby, the ductility of a rail steel is degraded. In addition, in the case where the Zr amount exceeds 0.2000%, a large amount of coarse Zr-based inclusions are generated; and thereby, the ductility of a rail steel is degraded. Therefore, the content of Zr is preferably in a range of 0.0001% to 0.2000%.

In addition, other than the above components, examples of elements included as impurities in a rail steel include P and S.

P is an element that degrades the ductility of a rail steel, and, in the case where more than 0.035% of P is included, its influence cannot be ignored. Therefore, the content of P is preferably in a range of 0.035% or less, and more preferably in a range of 0.020% or less.

S is an element that exists in a steel mainly in the form of inclusions (MnS and the like), and S brings about the embrittlement of a steel (degradation of the ductility). Particularly, in the case where the content of S exceeds 0.035%, the adverse effect on brittleness cannot be ignored. Therefore, the content of S is preferably set to be in a range of 0.035% or less, and more preferably in a range of 0.020% or lower.

Blooms for hot rolling having the above-mentioned composition are manufactured by the following method. Melting is conducted so as to obtain molten steel with a commonly used melting furnace such as a converter furnace, an electric furnace or the like. The molten steel is subjected to an ingot casting and breakdown rolling or a continuous casting so as to manufacture a bloom for hot rolling.

(2) Manufacturing Conditions

Next, the manufacturing conditions to manufacture the inventive rail (rail of the present invention) will be described.

The method of manufacturing the inventive rail includes a process in which a bloom is subjected to hot rolling to form the bloom into a rail, and a subsequent process in which a thermal treatment (heating and cooling) is carried out. The process of hot rolling includes a process in which the bloom is reheated and a process in which the bloom is subjected to finishing rolling.

(a) Heating Temperature

In the process of reheating the bloom for rail rolling during the hot rolling, the reheating temperature is not particularly limited. However, in the case where the reheating temperature is lower than 1,200° C., coarse Ti-based precipitates, V-based precipitates, or Ti—V complex precipitates which are precipitated during cooling after casting are not solid-solubilized. Thereby, it becomes impossible to finely precipitate the precipitates in austenite during rolling. Consequently, it becomes impossible to achieve suppression of austenite grain growth. Therefore, the heating temperature is preferably in a range of 1,200° C. or higher. Furthermore, it is more preferable that the holding time at 1,200° C. or higher be 40 minutes or longer in order to sufficiently solid-solubilize the coarse precipitates of Ti-based precipitates, V-based precipitates, or Ti—V complex precipitates in a steel.

Ti and V which are melted in a steel during the process of reheating a bloom for rail rolling can be precipitated finely at large amounts by utilizing strains introduced to austenite during rolling as nucleation sites in the final finishing rolling of the finishing rolling process during the hot rolling. However, in the case where the final finishing rolling temperature exceeds 1100° C., generation of the Ti-based precipitates is slow. Therefore, precipitates are coarsened even when the precipitates are precipitated by utilizing the strains induced in the hot rolling; and thereby, the effect of suppressing the growth of austenite grains is not obtained. In addition, in the case where rolling is carried out at a temperature of lower than 850° C., extremely fine precipitates are easy to generate; and thereby, pinning effect cannot be obtained. Therefore, an effect of suppressing recrystallization is obtained, instead of an effect of suppressing austenite grain growth; and thereby, a uniform structure cannot be obtained. Therefore, the final finishing rolling is preferably carried out at a temperature in a range of 850° C. to 1100° C. In addition, in this temperature range, Ti-based precipitates are easy to be finely precipitated as the finishing rolling temperature is decreased.

(b) Reasons why the Finishing Rolling Temperature is Limited

The reasons why the finishing rolling temperature is limited to $T_c-25 \leq FT \leq T_c+25$ (formula (3)) with respect to the value $T_c$ calculated by the formula (2) in the present invention will be described.

Ti and V are melted in a steel during the process of heating the bloom for rail rolling before the hot rolling, and Ti and V are precipitated in austenite as Ti-based precipitates (TiC, TiN, Ti(C,N)), V-based precipitates (VC, VN, V(C,N)) or Ti—V complex precipitates during the hot rolling; and thereby, austenite grain growth is suppressed. Furthermore, fine precipitates are precipitated by controlling the rolling temperature of the finishing rolling process in a temperature range in which precipitates are easily generated. As a result, growth of austenite grains can be further suppressed. This is because strains introduced to austenite during the hot rolling act as nucleation sites (sites where precipitates are easily generated).

However, the temperature range where precipitates are easily generated varies depending on not only the added amounts of Ti and V which are precipitate-forming elements, but also the amount of C which is added to manufacture a rail having sufficient wear resistance.

<Experiment 3>

Figure 3:
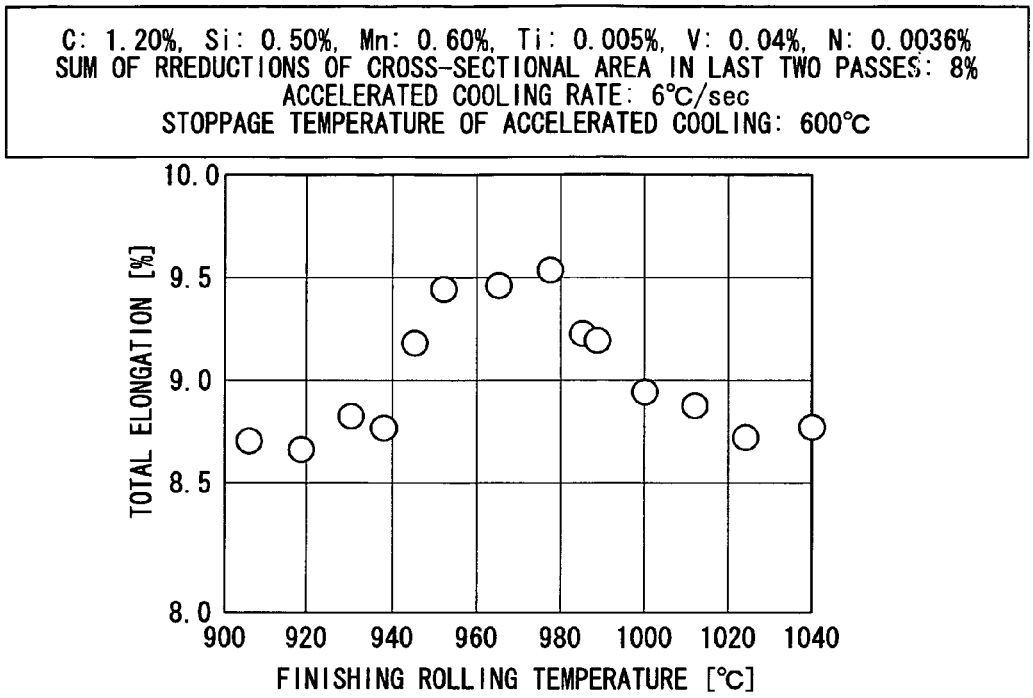
FIG. 3 is a view showing the relationship between the rolling temperatures and the total elongation in the tensile test results of hot-rolled sheets (steel rails) obtained by rolling blooms containing, in terms of percent by mass, C: 1.2%, Si: 0.50%, Mn: 0.60%, Ti: 0.005%, V: 0.04%, and N: 0.0036% under conditions where a finishing rolling temperature was in a range of 900° C. to 1,040° C., and a sum of reductions of cross-sectional area in last two passes was 8%.

Therefore, the inventors investigated in detail through experiments the relationship between a temperature range where precipitates are easy to generate and either of the C amount, the Ti amount, or the V amount. Firstly, blooms for rail rolling including C: 1.2%, Si: 0.50%, Mn: 0.60%, Ti: 0.005%, V: 0.04% (V/Ti=8.0), and N: 0.0036% were manufactured. The blooms were reheated and held at 1,280° C. for 60 minutes. Next, rolling was carried out under conditions where the finishing rolling temperature was either one of various values in a range of 900° C. to 1,040° C., and the sum of reductions of cross-sectional area in the last two passes was 8% in the finishing rolling process of the hot rolling. Then, accelerated cooling was carried out at a cooling rate of 6° C./sec from 800° C. which was within an austenite region to 600° C.; and thereby, steel rails were obtained. After the cooling, tensile tests were carried out. FIG. 3 shows the relationship between the finishing rolling temperature and the total elongation in the tensile test results of the steel rails. As shown in FIG. 3, the total elongation values of the steels were increased in a certain temperature range. As a result of observing austenite grain structures obtained by conditions of the respective finishing rolling temperatures, the austenite grain structures were fine in steels of which the total elongation were increased, compared with the austenite grain structures in other steels. The finishing rolling temperature by which the total elongation was increased was within a temperature region where Ti-based precipitates, V-based precipitates, and complex precipitates of Ti and V were easy to generate. Therefore, the precipitates were finely precipitated by utilizing dislocations introduced during the final finishing rolling as precipitation sites. As a result, the effect of suppressing austenite grain growth was increased. This is considered as the reason why the above-mentioned observation results were obtained.

<Experiment 4>

Figure 4:
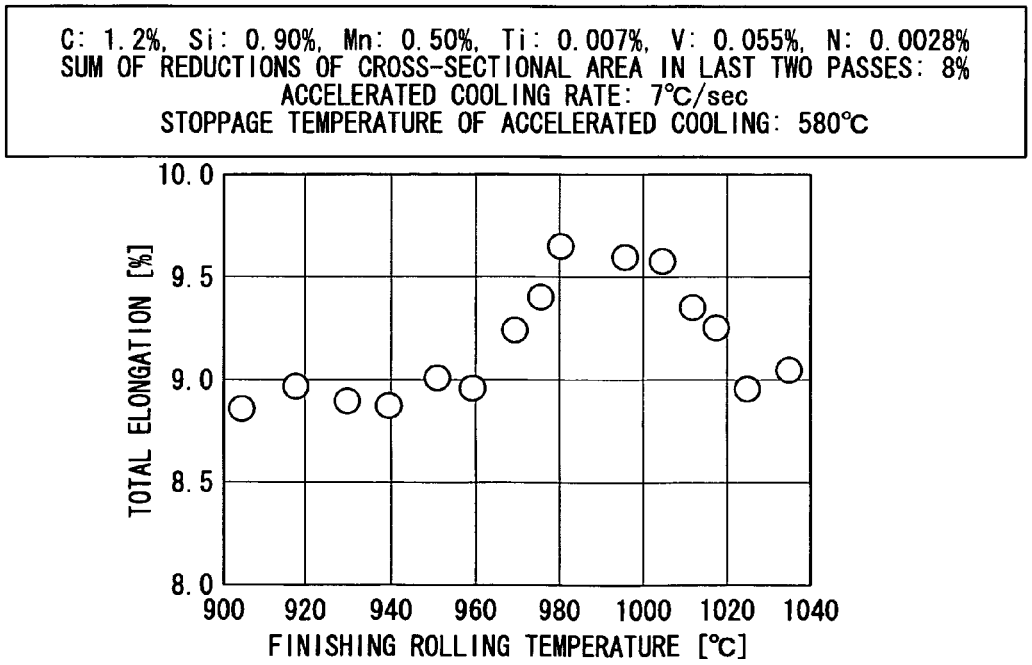
FIG. 4 is a view showing the relationship between the rolling temperatures and the total elongation in the tensile test results of hot-rolled sheets (steel rails) obtained by rolling blooms containing, in terms of percent by mass, C: 1.2%, Si: 0.90%, Mn: 0.50%, Ti: 0.007%, V: 0.055%, and N: 0.0028% under conditions where a finishing rolling temperature was in a range of 900° C. to 1,040° C., and a sum of reductions of cross-sectional area in last two passes was 8%.

Next, blooms for rail rolling including C: 1.2%, Si: 0.90%, Mn: 0.50%, Ti: 0.007%, V: 0.055% (V/Ti=7.9), and N: 0.0028% were manufactured. The blooms were reheated and held at 1,280° C. for 60 minutes. Next, rolling was carried out under conditions where the finishing rolling temperature was either one of various values in a range of 900° C. to 1,040° C., and the sum of reductions of cross-sectional area in the last two passes was 8% in the finishing rolling process of the hot rolling. Then, accelerated cooling was carried out at a cooling rate of 7° C./sec from 790° C. which was within an austenite region to 580° C.; and thereby, steel rails were obtained. After the cooling, tensile tests were carried out. FIG. 4 shows the relationship between the finishing rolling temperature and the total elongation in the tensile test results of the steel rails. As shown in FIG. 4, the total elongation values of the steels were increased in a certain temperature range. However, the peak temperature at which the total elongation value exhibited the peak was shifted to a higher temperature than that in FIG. 3. This is considered to be because the Ti amount and the V amount were larger than those in the blooms used in Experiment 3; and therefore, a temperature region where Ti-based precipitates, V-based precipitates, and complex precipitates of Ti and V were easy to generate was shifted to a higher temperature.

<Experiment 5>

Figure 5:
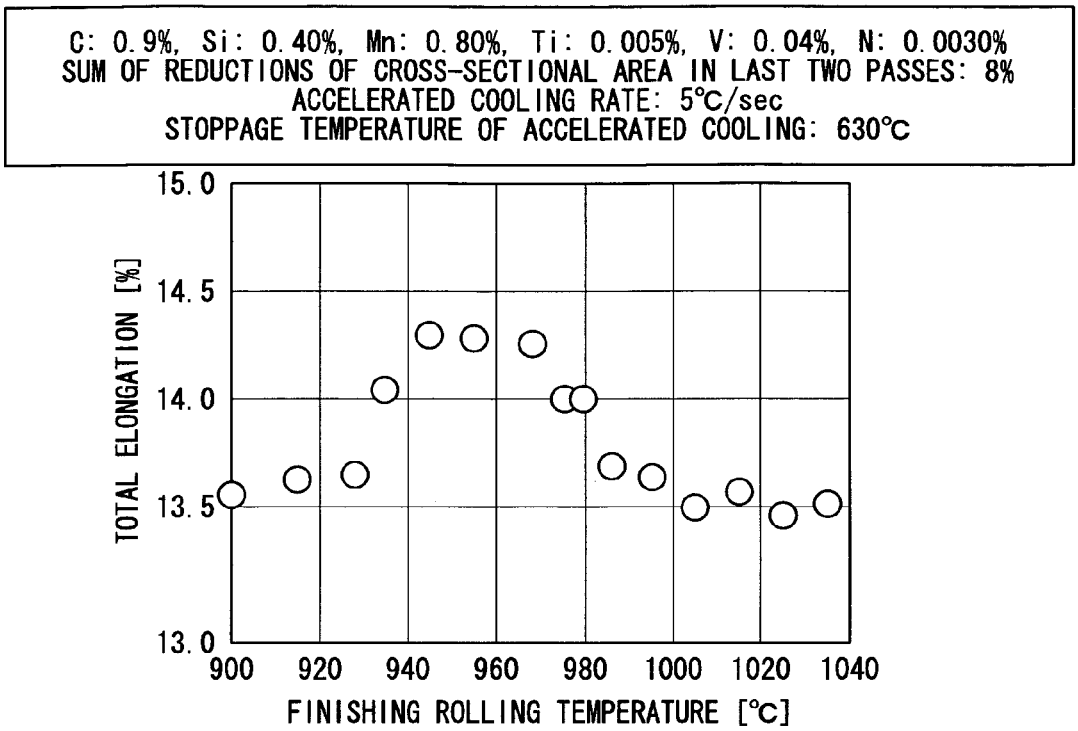
FIG. 5 is a view showing the relationship between the rolling temperatures and the total elongation in the tensile test results of hot-rolled sheets (steel rails) obtained by rolling blooms containing, in terms of percent by mass, C: 0.9%, Si: 0.40%, Mn: 0.80%, Ti: 0.005%, V: 0.04%, and N: 0.0030% under conditions where a finishing rolling temperature was in a range of 900° C. to 1,040° C., and a sum of reductions of cross-sectional area in last two passes was 8%.

Furthermore, blooms for rail rolling including C: 0.9%, Si: 0.40%, Mn: 0.80%, Ti: 0.005%, V: 0.04% (V/Ti=8.0), and N: 0.0030% were manufactured. The blooms were reheated and held at 1,280° C. for 60 minutes. Next, rolling was carried out under conditions where the finishing rolling temperature was either one of various values in a range of 900° C. to 1,040° C., and the sum of reductions of cross-sectional area in the last two passes was 8% in the finishing rolling process of the hot rolling. Then, accelerated cooling was carried out at a cooling rate of 5° C./sec from 780° C. which was within an austenite region to 630° C.; and thereby, steel rails were obtained. After the cooling, tensile tests were carried out. FIG. 5 shows the relationship between the finishing rolling temperature and the total elongation in the tensile test results of the steel rail. As shown in FIG. 5, the total elongation values of the steels were increased in a certain temperature range. Although the Ti amount and the V amount were the same as those in Experiment 1, the rolling temperature at which the total elongation value exhibited the peak was shifted to a lower temperature than that in the example of Experiment 3. This is considered to be because the generation temperature to generate precipitates was shifted to a lower temperature since the C amount was small while the Ti amount and the V amount were the same as those in the example of Experiment 3.

From the above-mentioned results, the following was found. It is necessary to control the finishing rolling temperature in a certain range in the finishing rolling process in accordance with the C amount, the Ti amount, and the V amount in order to suppress growth of austenite grains after the hot rolling and to improve the ductility in the case where a steel rail is manufactured which contains C: more than 0.85% to 1.40%, Si: 0.10% to 2.00%, Mn: 0.10% to 2.00%, Ti: 0.001% to 0.01%, V: 0.005% to 0.20%, and N: less than 0.0040% and has a ratio of the V amount to the Ti amount V/Ti in a range of 5 to 20 is manufactured.

Therefore, the inventors analyzed based on test data the relationship between the preferable finishing rolling temperatures in the finishing rolling process and either of the C amount, the Ti amount, or the V amount. As a result, the Ti-based precipitates, the V-based precipitates, or the complex precipitates of Ti and V are finely precipitated by utilizing dislocations introduced during the final rolling in the finishing rolling process as nucleation sites in the case where the finishing rolling temperature (FT) in the finishing rolling process is in a range of $T_c-25 \leq FT \leq T_c+25$ (the formula (3)) with respect to the value ($T_c$) calculated from the formula (2) that includes the C amount, the Ti amount, and the V amount. Therefore, it is possible to further suppress austenite grain growth (growth of austenite grains), compared with a case in which the FT is outside the above-specified range. In the case where the FT exceeds TC+25, generation of precipitates is extremely slow. Therefore, precipitates are coarsened even when the precipitates are precipitated by utilizing strains induced in the rolling; and thereby, the effect of growing austenite grains is not obtained. In addition, in the case where the rolling is carried out at a temperature lower than 850° C., extremely fine precipitates are easy to generate; and thereby, pinning effect cannot be obtained. In addition, the effect of suppressing recrystallization is obtained, instead of an effect of suppressing austenite grain growth; and thereby, a uniform structure cannot be obtained. Therefore, the final finishing rolling is preferably carried out at a temperature in a range of 850° C. to 1,100° C. Meanwhile, it is more preferable to adjust the finishing rolling temperature (FT) in the finishing rolling process in a range that fulfills $T_c-15 \leq FT \leq T_c+15$.

$$T_c=850+35\times[C]+1.35\times10^4\times[Ti]+180\times[V] \quad \text{Formula (2)}$$

(c) Reasons why the Reductions of Cross-Sectional Area in the Last Two Passes in the Finishing Rolling Process are Limited The sum of reductions of cross-sectional area in the last two passes of the finishing rolling process is preferably controlled to fulfill $R_c-5 \leq FR \leq R_c+5$ (formula (5)) with respect to the value $R_c$ calculated from the formula (4). The reasons will be described hereinafter.

As described above, Ti and V are melted in a steel in the process of heating the bloom for rail rolling, and Ti and V can be precipitated as fine precipitates of Ti-based precipitates (TiC, TiN, Ti(C,N)), V-based precipitates (VC, VN, V(C,N)) or Ti—V complex precipitates by utilizing dislocation introduced to austenite as nucleation sites during the final rolling in the finishing rolling process. However, since the generating rate of the precipitates is remarkably affected by the C amount, the Ti amount, and the V amount, the inventors considered that there is an optimal range for the sum of reductions of cross-sectional area in the last two passes in the finishing rolling process.

Therefore, the inventors investigated in detail the relationship between either of the C amount, the Ti amount, or the V amount, and a range of the sum of reductions of cross-sectional area in the last two passes in the finishing rolling process in which the precipitates are easy to generate.

<Experiment 6>

Figure 6:
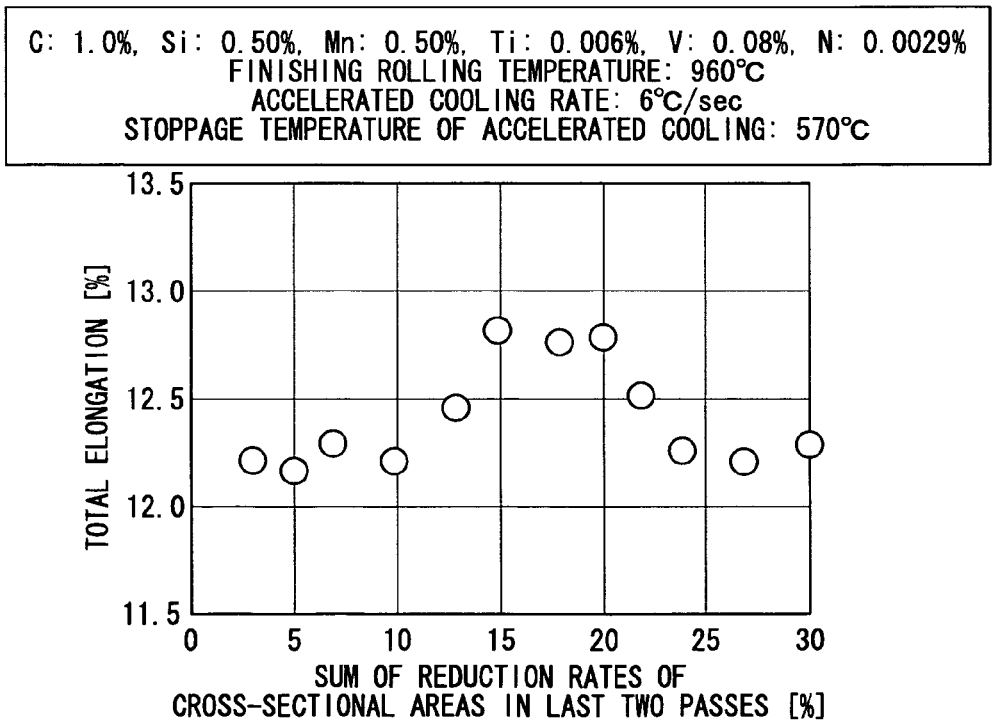
FIG. 6 is a view showing the relationship between a sum of reductions of cross-sectional area in last two passes and the total elongation in the tensile test results of steel rails obtained by hot-rolling blooms containing, in terms of percent by mass, C: 1.0%, Si: 0.50%, Mn: 0.50%, Ti: 0.006%, V: 0.08%, and N: 0.0029% under conditions where a finishing rolling temperature was in a range of 960° C., and a sum of reductions of cross-sectional area in last two passes varied.

Firstly, blooms for rail rolling containing C: 1.0%, Si: 0.50%, Mn: 0.50%, Ti: 0.006%, V: 0.08% (V/Ti=13.3), and N: 0.0029% were manufactured. These blooms were reheated and held at 1,280° C. for 60 minutes. Next, finish rolling was carried out under conditions where the finishing rolling temperature was 960° C. (within the preferable rolling temperature range determined by the formula (2)) and the sum of reductions of cross-sectional area in the last two passes was either one of various values. Then, accelerated cooling was carried out at a cooling rate of 6° C./sec from 750° C. which was within an austenite region to 570° C.; and thereby, steel rails were obtained. FIG. 6 shows the relationship between the sum of reductions of cross-sectional area in the last two passes and the total elongation in the tensile test results of the steel rail. As shown in FIG. 6, the total elongation values of the steels were increased in a certain range of the sum of reductions of cross-sectional area in the last two passes. As a result of observing the austenite grain structures obtained by the respective rolling conditions, the prior-austenite grain structures were fine in steels of which the total elongation were increased, compared with the prior-austenite grain structures in other steels. The density of dislocations introduced to austenite was increased in accordance with an increase in the reductions of cross-sectional area in the last two passes of the finishing rolling process in a temperature range in which precipitate are easy to generate. As a result, precipitation is accelerated; and thereby, precipitates are generated more finely at large amounts. This is considered as the reason why the above-mentioned observation results were obtained.

On the other hand, with regard to the steels of which the total elongations were not improved, in the case where the sum of reductions of cross-sectional area were low, it is considered to be because an increase in the dislocation density for further accelerating precipitation and generating a large amount of fine precipitates could not be obtained. Furthermore, the structure of a steel was observed which was prepared in the case where the sum of the reductions of cross-sectional area was high. As a result, a structure was confirmed which was considered to include partially-worked austenite remaining therein without being recrystallized. Precipitates are generated more finely at a larger amount due to an increase in the dislocation density in accordance with the increase in the sum of reductions of cross-sectional area, compared with those in steels of which the total elongations were improved. Thereby, recrystallization was suppressed. This is considered as the reason why the above-mentioned observation results were obtained.

<Experiment 7>

Figure 7:
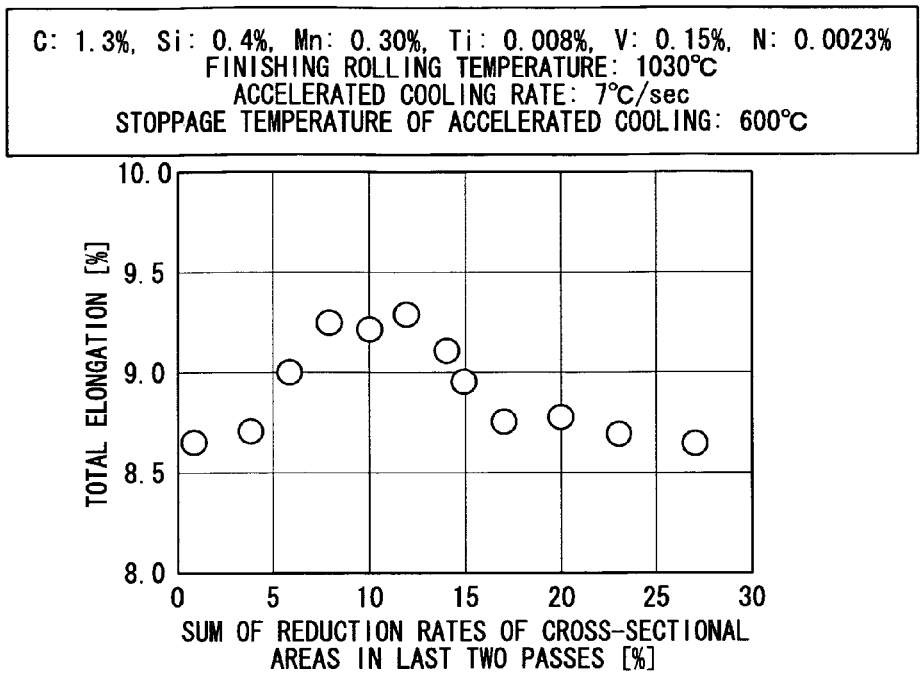
FIG. 7 is a view showing the relationship between a sum of reductions of cross-sectional area in last two passes and the total elongation in the tensile test results of steel rails obtained by hot-rolling blooms containing, in terms of percent by mass, C: 1.3%, Si: 0.40%, Mn: 0.30%, Ti: 0.008%, V: 0.15%, and N: 0.0023% under conditions where a finishing rolling temperature was in a range of 1030° C., and a sum of reductions of cross-sectional area in last two passes varied.

Next, blooms for rail rolling containing C: 1.3%, Si: 0.40%, Mn: 0.30%, Ti: 0.008%, V: 0.15% (V/Ti=18.8), and N: 0.0023% were manufactured. These blooms were reheated and held at 1,280° C. for 60 minutes. Next, hot rolling was carried out under conditions where the finishing rolling temperature was 1,030° C. (within a preferable rolling temperature range determined by the formula (2)) and the sum of reductions of cross-sectional area in the last two passes was either one of various values. Then, accelerated cooling was carried out at a cooling rate of 7° C./sec from 810° C. which was within an austenite region to 600° C.; and thereby, steel rails were obtained. FIG. 7 shows the relationship between the sum of reductions of cross-sectional area in the last two passes and the total elongation in the tensile test results of the steel rail. As shown in FIG. 7, similarly to the results of Experiment 6, the total elongation values of the steels were increased in a certain range of the sum of reductions of cross-sectional area in the last two passes. However, the range of the sum of reductions of cross-sectional area s by which the total elongation was increased was shifted to a lower temperature than that of the results in Experiment 6. This is considered to be because the increases in the C amount, the Ti amount, and the V amount accelerated the generation of precipitates; and thereby, the effects were obtained in spite that the sum of reductions of cross-sectional area was low.

From the above-mentioned results, the inventors found the following. It is necessary to control the finishing rolling temperature (FT) in a range that fulfills $T_c-25 \leq FT \leq T_c+25$ (formula (3)) with respect to the value ($T_c$) calculated from the formula (2) that includes the C amount, the Ti amount, and the V amount, and it is also necessary to control the sum of reductions of cross-sectional area in the last two passes in the range determined by the C amount, the Ti amount, and the V amount in the finishing rolling process in the case where a steel rail is manufactured which contains C: more than 0.85% to 1.40%, Ti: 0.001% to 0.01%, and V: 0.005% to 0.20%, and has a ratio V/Ti of the V amount to the Ti amount in a range of 5 to 20.

Therefore, the inventors analyzed based on test data the relationship between either of the C amount, the Ti amount, or the V amount, and the preferable sum of the reductions of cross-sectional area in the last two passes in the finishing rolling process. As a result, in the case where the sum (FR) of reductions of cross-sectional area in the last two passes in the finishing rolling process is in a range that fulfills $R_c-5 \leq FR \leq + R_c5$ (the formula (5)) with respect to the value ($R_c$) calculated from the formula (4) that includes the C amount, the Ti amount, and the V amount, the density of dislocations which are introduced to austenite during the final rolling in the finishing rolling process is increased; thereby, precipitation is accelerated, and precipitates can be generated more finely at a larger amount. Thereby, austenite grain growth (growth of austenite grains) can be suppressed. In the case where the FR exceeds $R_c+5$, the density of dislocation introduced to austenite is more increased in the last two passes of rolling than in the case where the FR is adjusted in the range of the formula (5). Thereby, precipitates are generated finely at large amounts. As a result, the recrystallization of austenite is suppressed, and an uneven structure is formed. In the case where the FR is smaller than $R_c-5$, precipitation is further accelerated; and thereby, a dislocation density for generating precipitates finely at large amounts cannot be obtained. It is more preferable to adjust the sum (FR) of reductions of cross-sectional area in the last two passes in a range that fulfills $R_c-3 \leq FR \leq R_c+3$.

$$R_c=35-13\times[C]-600\times[Ti]-20\times[V] \quad \text{Formula (4)}$$

(d) Cooling after Hot Rolling

The start temperature of the thermal treatment in which the accelerated cooling is carried out from the austenite temperature region using a cooling facility is not particularly limited. However, in the case where the start temperature of the accelerated cooling of the surface of the rail head portion is lower than 700° C., pearlite transformation begins before the accelerated cooling, and the lamellar spacing becomes coarse. Thereby, an increase in the hardness of the rail head portion cannot be achieved, and the wear resistance cannot be secured. In addition, a pro-eutectoid cementite structure is generated depending on the carbon amount or the alloy components of a steel; and thereby, the ductility of the surface of the rail head portion is degraded. Therefore, the start temperature of the accelerated cooling of the surface of the rail head portion is preferably set to be in a range of 700° C. or higher.

The cooling after the finishing rolling is not particularly limited. However, in the case where a slow cooling having a cooling rate of less than 0.5° C./sec is carried out, the Ti-based precipitates, the V-based precipitates, or the complex precipitates of Ti and V, which are precipitated during the finishing rolling, are coarsened. Thereby, there is a risk in which the effect of the precipitates to suppress austenite grain growth becomes weak. In addition, in the case where the cooling rate is lower than 2° C./sec, a pro-eutectoid cementite structure is generated in a high temperature region during the accelerated cooling depending on the component system; and thereby, the toughness and the ductility of the rail are degraded. In addition, the pearlite transformation begins in a high-temperature range during the accelerated cooling; and thereby, a pearlite structure having low hardness is generated. As a result, it becomes difficult to increase the strength. On the other hand, in the case where the cooling rate exceeds 30° C./sec, the cooling rate is not stabilized even when any refrigerant such as air and mist is used. Therefore, it becomes difficult to control the cooling stoppage temperature (temperature at which the cooling is stopped). As a result, pearlite transformation begins before the rail reaches an apparatus for carrying out the accelerated cooling due to excessive cooling; and thereby, the microstructure becomes pearlite having low hardness. Therefore, the range of the cooling rate is preferably 0.5° C./sec to 30° C./sec in order to suppress the coarsening of the precipitates after the finishing rolling and to minimize the grain growth of austenite (growth of austenite grains). Meanwhile, since the grain growth of austenite (growth of austenite grains) hardly occurs in a temperature range of below 800° C., the cooling after the finishing rolling may be conducted until the temperature reaches (drops to) 800° C. from the viewpoint of the grain growth.

Furthermore, in the case where the accelerated cooling is stopped in a temperature region exceeding 650° C., a large amount of pearlite having low hardness is generated in the subsequent retention region; and thereby, it becomes difficult to increase the strength. On the other hand, in the case where the accelerated cooling is stopped in a temperature region of lower than 550° C., a bainite structure that is harmful to the wear resistance of a rail is easy to generate in the subsequent retention region. Therefore, the stoppage temperature of the accelerated cooling (temperature at which the accelerated cooling is stopped) is preferably in a range of 550° C. to 650° C.

Next, the metallographic structure (microstructure) of the inventive rail (rail of the present invention) will be described.

It is preferable that the metallographic structure (microstructure) of the head portion of the inventive rail (rail of the present invention) be composed of pearlite structure. However, there are cases in which a small amount of one or more of a pro-eutectoid ferrite structure, a bainite structure, and a martensite structure are included in the pearlite structure in the rail web portion, the head surface portion, the head internal portion, and the base portion depending on the component system and the conditions of the accelerated cooling. However, even in the case where a small amount of these structures are included, these structures do not have an adverse effect on the characteristics of a rail. Therefore, the high-carbon pearlitic steel rail having excellent ductility may include one or more of a pro-eutectoid ferrite structure, a pro-eutectoid cementite structure, a bainite structure, and a martensite structure at an area ratio of 5% or less in the rail cross-sectional area.

In addition, the sizes of the Ti-based precipitates, the V-based precipitates, or the Ti—V complex precipitates in steel of the inventive rail are not particularly limited. However, in the case where the average grain diameter of these precipitates exceeds 100 nm, or in the case where the average grain diameter of these precipitates is smaller than 10 nm, sufficient suppression of austenite grain growth by the pinning effect cannot be achieved. Therefore, the average grain diameter of the precipitates is preferably set to be in a range of 10 nm to 100 nm.

Furthermore, even when precipitates having an average grain diameter of 10 nm to 100 nm are generated, the effect of suppressing the austenite grain growth is not exhibited in the case where the density is lower than 50,000 precipitates per 1 $mm^2$; and therefore, the ductility is not improved. On the other hand, in the case where the density is above 500,000 precipitates per 1 $mm^2$, deformation of the pearlite structure is restricted; and therefore, conversely, the ductility is degraded. Consequently, the Ti-based precipitates, the V-based precipitates, or the Ti—V complex precipitates are preferably included at a density in a range of 50,000 precipitates to 500,000 precipitates per 1 $mm^2$ in steel of the inventive rail.

Here, the methods of measuring the density and sizes of the Ti-based precipitates, the V-based precipitates, or the Ti—V complex precipitates will be described.

The density of the precipitates is measured by the following method. An extracted replica specimen or a thin film specimen is prepared from an arbitrary portion of a rail steel. The specimen is observed using a transmission electron microscope (TEM), and the number of precipitates having sizes of 10 nm to 100 nm is measured at an area of 1000 $\mu m^2$ or larger. This measurement result is converted to the number per unit area. For example, in the case where a sight of 100 mm×80 mm is observed with a magnification of 20.000-fold, the observation area of this sight is 20 $\mu m^2$; and therefore, observation is carried out for at least 50 sights. If the number of precipitates having sizes of 100 nm or smaller in 50 sights (1000 $\mu m^2$) is 100 precipitates, the density of the precipitates can be converted to 100,000 particles per 1 $mm^2$.

Next, the sizes of the precipitates are measured by the following method. It is possible to measure the sizes as the average grain diameters of the Ti-based precipitates, the V-based precipitates, or the Ti—V complex precipitates which are observed by the above-mentioned replica method and the like. In the case where a precipitate is almost truly spherical, the diameter of a ball having the same area as the precipitate is considered as the average grain diameter. In the case where a precipitate is not spherical, but ellipsoidal or a rectangular parallelepiped, the average value of the long diameter (long side) and the short diameter (short side) is considered as the average grain diameter.

In addition, under observation, the precipitate can be identified as either one of the Ti-based precipitate, the V-based precipitate, or the Ti—V complex precipitate by the composition analysis using an energy dispersive X-ray (EDX) spectroscopy apparatus equipped in a TEM, the crystal structure analysis of an electron ray diffraction image by the TEM, and the like.

EXAMPLES

Next, the examples of the present invention will be described.

Table 1 shows component compositions of rails and blooms used in the examples. Meanwhile, the compositions of the rails are as follow:

(1) Inventive Rails (17 Rails)

Marks 'A' to 'M' and 'O' to 'R': steel rails containing C, Si, Mn, Ti, and N in the above-mentioned component ranges and having ratios of V/Ti in a range of 5 to 20% by mass (2) Comparative Steel Rails (17 Rails)

Marks 'a' to 'k': steel rails in which added amounts of C, Si, Mn, Ti, V, and N are outside the above-claimed ranges (comparative rails 1, 11 rails)

Marks 'l' to 'q': steel rails in which amounts of C, Si, Mn, Ti, V, and N are in the above-mentioned component ranges, but ratios of V/Ti are outside a range of 5 to 20% by mass (comparative rails 2, 6 rails)

TABLE 1

| | | Chemical composition (% by mass) | | | | | | | |
|---|---|---|---|---|---|---|---|---|---|
| Rail | Mark | C | Si | Mn | Ti | V | N | Other | V/Ti |
| Inventive rails | A | 0.88 | 0.80 | 0.42 | 0.009 | 0.12 | 0.0030 | | 13.3 |
| | B | 1.38 | 0.44 | 0.65 | 0.008 | 0.07 | 0.0025 | | 8.8 |
| | C | 1.05 | 0.15 | 0.82 | 0.01 | 0.18 | 0.0038 | | 18.0 |
| | D | 1.20 | 1.95 | 0.30 | 0.01 | 0.15 | 0.0024 | | 15.0 |

TABLE 1-continued

| Rail | Mark | Chemical composition (% by mass) C | Si | Mn | Ti | V | N | Other | V/Ti |
|---|---|---|---|---|---|---|---|---|---|
| | E | 1.26 | 1.10 | 0.15 | 0.006 | 0.07 | 0.0036 | Cr: 0.20 | 11.7 |
| | F | 0.92 | 1.07 | 1.90 | 0.005 | 0.09 | 0.0036 | | 18.0 |
| | G | 1.01 | 1.54 | 0.69 | 0.002 | 0.02 | 0.0036 | Mo: 0.02 | 10.0 |
| | H | 1.12 | 0.95 | 0.34 | 0.01 | 0.14 | 0.0037 | | 14.0 |
| | I | 1.28 | 0.42 | 0.77 | 0.001 | 0.007 | 0.0033 | Nb: 0.008 | 7.0 |
| | J | 0.98 | 0.75 | 1.08 | 0.009 | 0.18 | 0.0029 | Mg: 0.0009 | 20.0 |
| | K | 1.14 | 0.68 | 0.45 | 0.007 | 0.09 | 0.0039 | | 12.9 |
| | L | 1.06 | 0.64 | 0.45 | 0.007 | 0.04 | 0.0033 | Cu: 0.05 | 5.7 |
| | M | 0.95 | 0.52 | 0.68 | 0.006 | 0.12 | 0.0027 | | 20.0 |
| | O | 1.03 | 0.60 | 0.49 | 0.004 | 0.04 | 0.0034 | Al: 0.005, Ca: 0.0008 | 10.0 |
| | P | 0.95 | 0.87 | 0.82 | 0.005 | 0.03 | 0.0033 | B: 0.0004 | 6.0 |
| | Q | 1.10 | 0.66 | 0.42 | 0.005 | 0.07 | 0.0027 | Co: 0.2, Ni: 0.02 | 14.0 |
| | R | 0.95 | 0.88 | 0.70 | 0.006 | 0.04 | 0.0029 | Zr: 0.0003 | 6.6 |
| Comparative rails 1 | a | 0.77 | 0.62 | 0.35 | 0.005 | 0.10 | 0.0034 | Zr: 0.0005 | 20.0 |
| | b | 1.50 | 0.61 | 0.43 | 0.004 | 0.07 | 0.0036 | | 17.5 |
| | c | 1.02 | 0.14 | 1.20 | 0.004 | 0.05 | 0.0038 | | 12.5 |
| | d | 1.20 | 2.20 | 0.67 | 0.006 | 0.09 | 0.0035 | B: 0.0004 | 15.0 |
| | e | 1.08 | 1.02 | 0.12 | 0.004 | 0.07 | 0.0036 | | 17.5 |
| | f | 0.96 | 0.73 | 2.24 | 0.005 | 0.08 | 0.0038 | Ca: 0.0007 | 16.0 |
| | g | 1.25 | 0.89 | 0.46 | 0.0008 | 0.03 | 0.0028 | Co: 0.10 | 37.5 |
| | h | 1.29 | 1.10 | 0.92 | 0.02 | 0.05 | 0.0035 | | 2.5 |
| | i | 1.38 | 0.45 | 1.21 | 0.009 | 0.001 | 0.0025 | Ni: 0.03 | 0.1 |
| | j | 1.12 | 0.55 | 0.28 | 0.005 | 0.29 | 0.0031 | | 58.0 |
| | k | 0.87 | 0.70 | 0.99 | 0.007 | 0.10 | 0.0060 | Al: 0.008 | 14.3 |
| Comparative rails 2 | l | 0.88 | 0.80 | 0.42 | 0.006 | 0.17 | 0.0030 | | 28.3 |
| | m | 1.05 | 0.15 | 0.82 | 0.01 | 0.04 | 0.0038 | | 4.0 |
| | n | 1.01 | 1.54 | 0.69 | 0.005 | 0.11 | 0.0036 | Mo: 0.02 | 22.0 |
| | o | 1.12 | 0.95 | 0.34 | 0.006 | 0.15 | 0.0037 | | 25.0 |
| | p | 1.06 | 0.64 | 0.45 | 0.009 | 0.03 | 0.0033 | Cu: 0.05 | 3.3 |
| | q | 0.95 | 0.52 | 0.68 | 0.002 | 0.06 | 0.0027 | | 30.0 |

The components were adjusted in a converter furnace, and then casting was carried out by the continuous casting method. Thereby, blooms for rail rolling having the components in Table 1 were manufactured.

The inventive rails, the comparative rails 1, and the comparative rails 2 having the components in Table 1 were manufactured by the following method. The blooms for rail rolling having the components in Table 1 were heated and held at a reheating temperature of 1280° C. for 80 minutes. Next, in the final finishing rolling process of hot rolling, the rolling was carried out under conditions where the final finishing rolling temperature was 870° C., and the sum of reductions of cross-sectional area in the last two passes was about 27%. After the hot rolling, accelerated cooling was carried out at a cooling rate of 8° C./sec from 780° C. until the surface temperature of a rail became 560° C. Thereby, the rails were manufactured.

Figure 8:
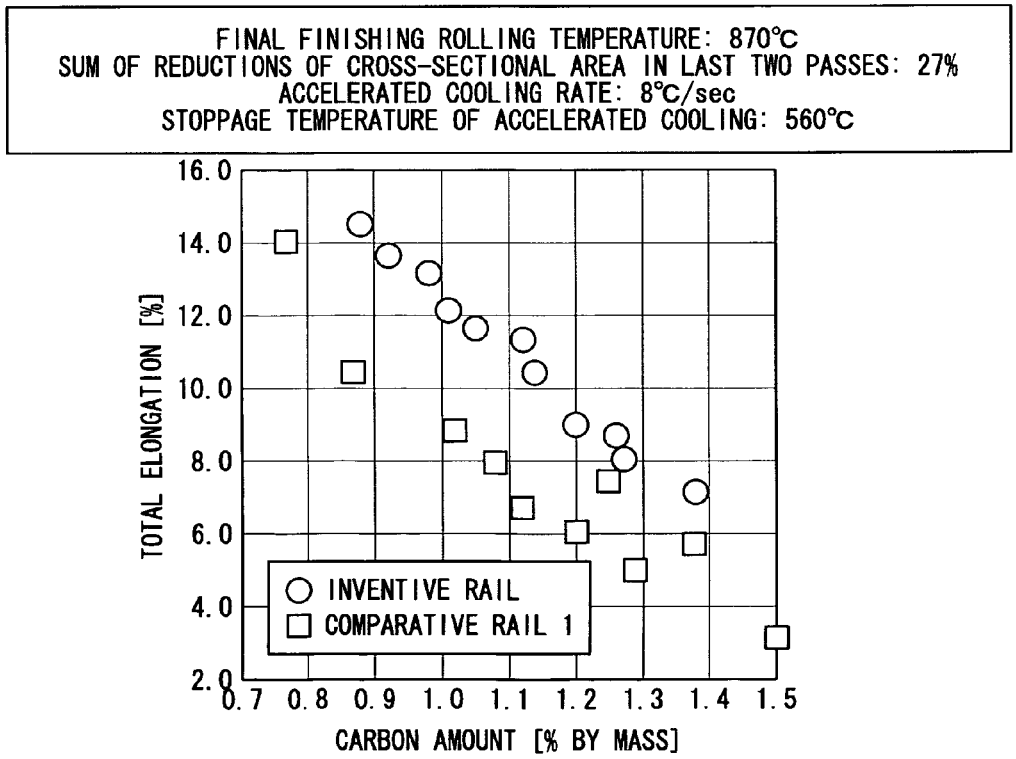
FIG. 8 is a view showing the relationship between the carbon amount and the total elongation in the tensile test results of the inventive rails (rails of the present invention) and the comparative rails 1.
Figure 9:
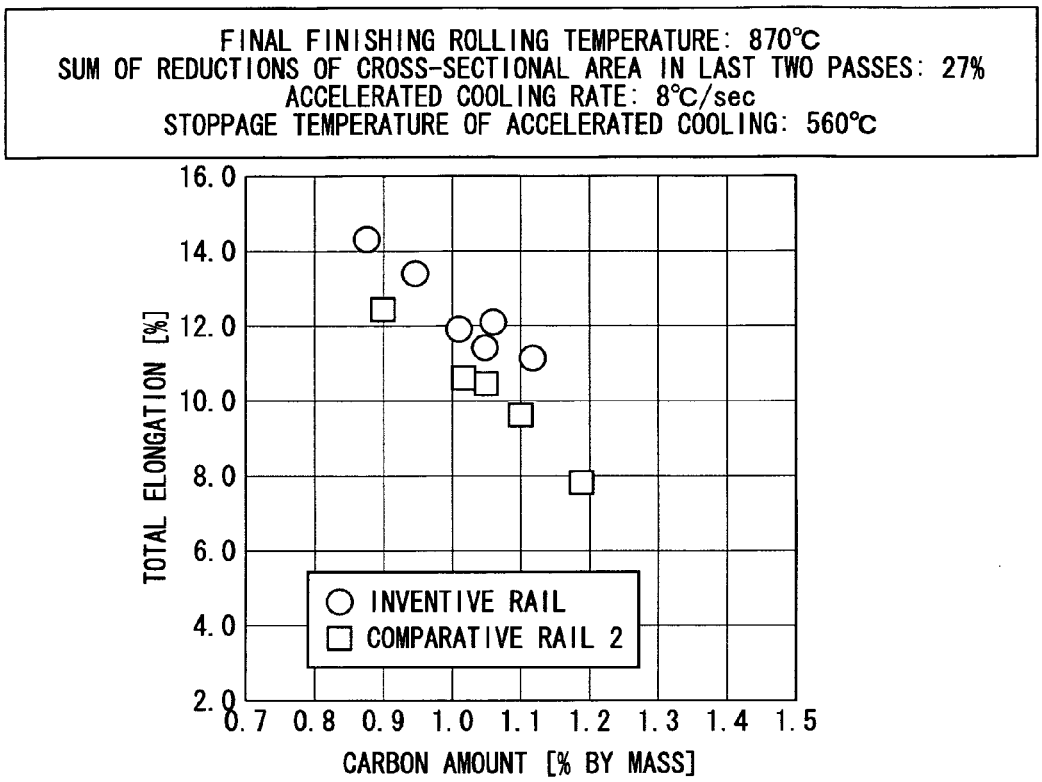
FIG. 9 is a view showing the relationship between the carbon amounts and the total elongation in the tensile test results of the inventive rails (rails of the present invention) and the comparative rails 2.

The microstructure of a portion located 2 mm below the head surface of the manufactured rail was observed. In addition, a tensile test specimen was taken from a portion located 5 mm below the head top surface. A tensile test was carried out; and thereby, the total elongation value was measured. The obtained results are shown in Tables 2 and 3. In addition, the relationship between the total elongation value and the carbon amount is plotted and shown in FIGS. 8 and 9.

Meanwhile, the conditions of the tensile test are as follow:

(1) Tensile Test of Head Portion

Tester: small-sized universal tensile tester

Specimen shape: similar to No. 4 specimen of JIS Z2201

Figure 10:
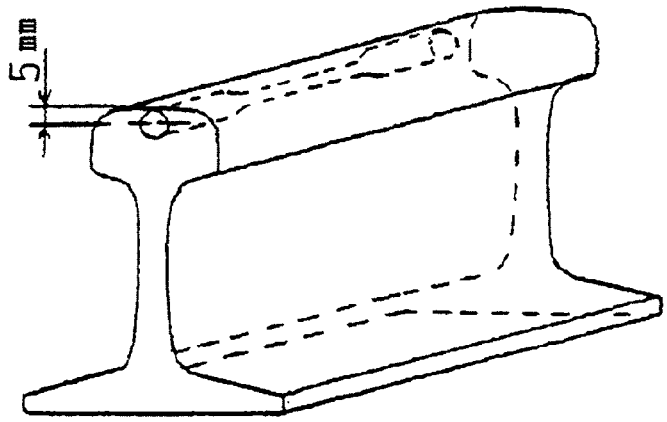
FIG. 10 is a view showing a location where specimen for a tensile test of a head portion is taken.

Location from which specimen was taken: 5 mm below the head surface (refer to FIG. 10)

Length of parallel portion: 25 mm, Diameter of parallel portion: 6 mm, Distance between the elongation measurement marks: 21 mm Tension rate: 10 mm/min, Test temperature: room temperature (20° C.)

TABLE 2

| Rail | Mark | Microstructure | Total elongation [%] |
|---|---|---|---|
| Inventive rails | A | Pearlite | 14.5 |
| | B | Pearlite | 7.1 |
| | C | Pearlite | 11.6 |
| | D | Pearlite | 9.0 |
| | E | Pearlite | 8.7 |
| | F | Pearlite | 13.6 |
| | G | Pearlite | 12.1 |
| | H | Pearlite | 11.3 |
| | I | Pearlite | 8.0 |
| | J | Pearlite | 13.1 |
| | K | Pearlite | 10.4 |
| | O | Pearlite | 11.2 |
| | P | Pearlite | 12.9 |
| | Q | Pearlite | 11.0 |
| | R | Pearlite | 12.7 |
| Comparative rails 1 | a | Pearlite + Pro-eutectoid fertile | 14.0 |
| | b | Pearlite + Pro-eutectoid cementite | 3.1 |
| | c | Pearlite + Pro-eutectoid cementite | 8.8 |
| | d | Pearlite | 6.0 |
| | e | Pearlite + Pro-eutectoid cementite | 7.9 |
| | f | Pearlite + Martensite | 4.4 |
| | g | Pearlite | 7.4 |
| | h | Pearlite (coarse Ti-based precipitate) | 5.0 |
| | i | Pearlite | 5.7 |
| | j | Pearlite (coarse V-based precipitate) | 6.7 |
| | k | Pearlite (coarse Ti nitride) | 10.4 |

TABLE 3

| Rail | Mark | V/Ti | Total elongation [%] |
|---|---|---|---|
| Inventive rails | A | 13.3 | 14.5 |
| | C | 18.0 | 11.6 |
| | G | 10.0 | 12.1 |
| | H | 14.0 | 11.3 |
| | L | 5.7 | 12.3 |
| | M | 20.0 | 13.6 |
| Comparative rails 2 | l | 28.3 | 12.6 |
| | m | 4.0 | 10.8 |
| | n | 22.0 | 11.0 |
| | o | 25.0 | 10.4 |
| | p | 3.3 | 11.1 |
| | q | 30.0 | 12.2 |

The added amounts of C, Si, Mn, Ti, V, and N were adjusted in a certain ranges in the inventive rail steels (Marks 'A' to 'K'). Therefore, as shown in Table 2, the inventive rail steels included a pearlite structure that was excellent in the ductility, and a pro-eutectoid cementite structure, a martensite structure, coarse precipitates, and the like, which had an adverse effect on the ductility of steel rails, were not generated in comparison to the comparative rail steels 1 (Marks 'a' to 'k'). With regard to Marks 'g' and 'i' of the comparative rails 1, since the added amount of Ti or V was below the range defined in the present invention, the density of precipitates that suppressed austenite grain growth lacked. Therefore, improvement in the ductility was weak.

With regard to the comparative rail steels 2 (Marks 'l' to 'q'), the amounts of C, Si, Mn, Ti, V, and N were in the ranges of the present invention. In addition, the rail steels of Marks 'l' to 'q' had the same amounts of C, Si, Mn, and N as those of the rail steels of Marks 'A', 'C', 'G', 'H', 'L', and 'M', respectively. However, as shown in Table 3, the rail steels of Marks 'l' to 'q' had ratios of the added amounts of V to Ti which were values of V/Ti outside the range defined by the present invention. Therefore, the generation temperature of V-based precipitates was different from the generation temperature of Ti-based precipitates; and thereby, the same precipitates as the invention steel could not be generated even when strains introduced during the final finishing rolling of hot rolling were utilized. As a result, austenite grain growth could not be controlled sufficiently; and thereby, the ductility was not improved. The total elongation was improved by 5% or more in rails having values of V/Ti in a range of 5 to 20 in comparison to rails having the same components except Ti and V and values of V/Ti outside a range of 5 to 20. Specifically, when Mark 'A' and Mark 'l', Mark 'C' and Mark 'm', Mark 'G' and Mark 'n', Mark 'H' and Mark 'o', Mark 'L' and Mark 'p' and Mark 'M' and Mark 'q' are compared respectively, the total elongations are improved by 5% or more in the rate of elongation.

Next, the rails of Nos. 1 to 8 in Table 4 were manufactured by the following method.

The blooms for rail rolling of Marks 'A', 'B', 'D', 'G', 'I', 'K', and 'M' shown in Table 1 were subjected to hot rolling at the finishing rolling temperatures (FT) in Table 4. Meanwhile, the sums of reductions of cross-sectional area in the last two passes were set to be 25% with regard to all the rails.

With regard to all the rails, the finishing rolling temperatures (FT) in the finishing rolling process were controlled in a range that fulfilled $T_c-25 \leq FT \leq T_c+25$ with respect to the values $T_c$ calculated by the formula (2).

As shown in Table 4, the total elongations were improved in the case where the values of FT were adjusted in a range of ($T_c-25 \leq FT \leq T_c+25$) defined by the formula (3) compared with those of the rails in Table 1 whose values of FT were outside the range defined by the present invention.

TABLE 4

| No. | Mark | Chemical composition (% by mass) C | Ti | V | $T_c-25$ | $T_c$ value | $T_c+25$ | Finishing rolling temperature FT (° C.) | Total elongation (%) |
|---|---|---|---|---|---|---|---|---|---|
| 1 | A | 0.88 | 0.009 | 0.12 | 999 | 1,024 | 1,049 | 1,010 | 14.9 |
| 2 | B | 1.38 | 0.008 | 0.07 | 994 | 1,019 | 1,044 | 1,040 | 7.3 |
| 3 | D | 1.20 | 0.010 | 0.15 | 1,029 | 1,054 | 1,079 | 1,050 | 9.4 |
| 4 | G | 1.01 | 0.002 | 0.02 | 891 | 916 | 941 | 940 | 12.3 |
| 5 | I | 1.27 | 0.001 | 0.007 | 884 | 909 | 934 | 890 | 8.3 |
| 6 | K | 1.14 | 0.007 | 0.09 | 976 | 1,001 | 1,026 | 1,020 | 10.6 |
| 7 | L | 1.06 | 0.007 | 0.04 | 964 | 989 | 1,014 | 970 | 12.6 |
| 8 | M | 0.95 | 0.006 | 0.12 | 961 | 986 | 1,011 | 1,000 | 14.1 |

Sum of reductions of cross-sectional area in the last 2 passes: 25%

Next, the rails of Nos. 9 to 15 in Table 5 were manufactured by the following method.

The blooms for rail rolling of Marks 'C', 'E', 'F', 'H', 'J', 'L', and 'M' shown in Table 1 were subjected to hot rolling at the finishing rolling temperatures (FT) and the sums of reductions of cross-sectional area (FR) in the last two passes in Table 5.

With regard to all the rails, the finishing rolling temperatures (FT) in the finishing rolling process were in a range that fulfilled $T_c-25 \leq F \leq T_c+25$ with respect to the values $T_c$ calculated by the formula (2). In addition, the sums of reductions of cross-sectional area (FR) in the last two passes were controlled in a range that fulfilled $R_c-5 \leq FT \leq +5$ with respect to the values $R_c$ calculated by the formula (4).

As shown in Table 5, the total elongations were further improved by adjusting the finishing rolling temperatures (FT) in the range defined by the present invention and controlling the sums of reductions of cross-sectional area (FR) in the last two passes in the range defined by the formula (5).

TABLE 5

| No. | Mark | Chemical composition (% by mass) C | Ti | V | $T_c$ − 25 | $T_c$ value | $T_c$ + 25 | Finishing rolling temperature FT (° C.) | $R_c$ − 5 | $R_c$ value | $R_c$ + 5 | Sum of reductions of cross-sectional area in the last two passes FR (%) | Total elongation (%) |
|---|---|---|---|---|---|---|---|---|---|---|---|---|---|
| 9 | C | 1.05 | 0.01 | 0.18 | 1,029 | 1,054 | 1,079 | 1,030 | 7 | 12 | 17 | 16 | 12.0 |
| 10 | E | 1.26 | 0.006 | 0.07 | 963 | 988 | 1,013 | 970 | 9 | 14 | 19 | 15 | 9.2 |
| 11 | F | 0.92 | 0.005 | 0.09 | 941 | 966 | 991 | 950 | 13 | 18 | 23 | 23 | 14.0 |
| 12 | H | 1.12 | 0.01 | 0.14 | 1,024 | 1,049 | 1,074 | 1,030 | 7 | 12 | 17 | 16 | 11.7 |
| 13 | J | 0.98 | 0.009 | 0.18 | 1,013 | 1,038 | 1,063 | 1,050 | 8 | 13 | 18 | 8 | 13.7 |
| 14 | L | 1.06 | 0.007 | 0.04 | 964 | 989 | 1,014 | 1,010 | 11 | 16 | 21 | 19 | 12.7 |
| 15 | M | 0.95 | 0.006 | 0.12 | 961 | 986 | 1,011 | 980 | 12 | 17 | 22 | 20 | 14.4 |

In accordance with the present invention, the contents of C, Si, Mn, Ti, V, and N are adjusted in a certain ranges and, furthermore, the ratio of the added amounts of V to Ti is adjusted in the range of the formula (1). Thereby, austenite grain growth is suppressed (refinement of the pearlite structure). As a result, it becomes possible to improve the ductility, and rails including a pearlite structure that is excellent in the ductility can be stably manufactured. Furthermore, in the process of hot-rolling a bloom having a ratio of the added amounts of V to Ti which is adjusted in the range of the formula (1), the finishing rolling temperature (FT) is controlled in a range that fulfills $T_c-25 \leq FT \leq T_c+25$ with respect to the value $T_c$ calculated by the formula (2), and the sum of reductions of cross-sectional area (FR) in the last two passes is controlled in a range that fulfills $R_c-5 \leq FR \leq R_c+5$ with respect to the value $R_c$ calculated by the formula (4). Thereby, rails including a pearlite structure that is further superior in the ductility can be stably manufactured.

INDUSTRIAL APPLICABILITY

The high-carbon pearlitic steel rail of the present invention includes a large amount of for improving the wear resistance. However, since the ductility is improved, improvement of the service life can be achieved. Therefore, the high-carbon pearlitic steel rail of the present invention can be preferably applied to rails for heavy haul railways.

The invention claimed is:

1. A pearlitic steel rail, consisting of: in terms of percent by mass,

C: more than 0.85% to 1.40%;

Si: 0.10% to 2.00%;

Mn: 0.10% to 2.00%;

Ti: 0.003% to 0.01%;

V: 0.005% to 0.20%;

N: 0.0024 to less than 0.0040%; and a balance of Fe and inevitable impurities, wherein contents of Ti and V fulfill the following formula (1), and a rail head portion of the pearlitic steel rail has a pearlite structure, $$5 \leq [V(\%\text{ by mass})]/[Ti(\%\text{ by mass})] \leq 20 \quad \text{Formula (1).}$$

2. A method for manufacturing a pearlitic rail, the method comprising subjecting a bloom to hot rolling, wherein the bloom consists of: in terms of percent by mass, C: more than 0.85% to 1.40%; Si: 0.10% to 2.00%; Mn: 0.10% to 2.00%; Ti: 0.003% to 0.01% V: 0.005% to 0.20%; and N: 0.0024 to less than 0.0040%; and a balance of Fe and inevitable impurities, and contents of Ti and V fulfill the following formula (1), and finishing rolling of the hot rolling is carried out under conditions where a finishing rolling temperature FT in terms of ° C. is set to be in a range represented by the following formula (3), wherein Tc is represented by the following formula (2) in which [C] is the content of C in terms of % by mass, [V] is the content of V in terms of % by mass, and [Ti] is the content of Ti in terms of % by mass of the bloom, $$5 \leq [V(\%\text{ by mass})]/[Ti(\%\text{ by mass})] \leq 20 \quad \text{Formula (1)}$$

$$Tc = 850 + 35 \times [C] + 1.35 \times 104 \times [Ti] + 180 \times [V] \quad \text{Formula (2)}$$

$$Tc - 25 \leq FT \leq Tc + 25 \quad \text{Formula (3).}$$

3. The method for manufacturing a pearlitic rail according to claim 2, wherein the finishing rolling is carried out under conditions where a sum FR in terms of % of reductions of cross-sectional area in last two passes is set to be in a range represented by the following formula (5), wherein R, is represented by the following formula (4) in which [C] is the content of C in terms of % by mass, [V] is the content of V in terms of % by mass, and [Ti] is the content of Ti in terms of % by mass of the bloom, $$R_c = 35 - 13 \times [C] - 600 \times [Ti] - 20 \times [V] \quad \text{Formula (4)}$$

$$R_c - 5 \leq FR \leq R_c + 5 \quad \text{Formula (5).}$$

4. The pearlitic steel rail according to claim 1, wherein an average grain diameter of Ti-based precipitates, V-based precipitates, or Ti—V complex precipitates is in a range of 10 nm to 100 nm.

5. The pearlitic steel rail according to claim 1, wherein a density of Ti-based precipitates, V-based precipitates, or Ti—V complex precipitates is in a range of 50,000 precipitates to 500,000 precipitates per 1 $mm^2$.

6. The pearlitic steel rail according to claim 4, wherein a density of Ti-based precipitates, V-based precipitates, or Ti—V complex precipitates is in a range of 50,000 precipitates to 500,000 precipitates per 1 $mm^2$.

7. The pearlitic steel rail according to claim 1, wherein N is 0.0024 to 0.0039%.

8. A pearlitic steel rail, consisting of: in terms of percent by mass,

C: more than 0.85% to 1.40%;

Si: 0.10% to 2.00%;

Mn: 0.10% to 2.00%;

Ti: 0.003% to 0.01%;

V: 0.005% to 0.20%;

N: 0.0024 to less than 0.0040%;

one or more selected from the group consisting of Nb: 0.002% to 0.050%, Cr: 0.05% to 2.00%, Mo: 0.01% to 0.50%, Co: 0.10% to 2.00%, Cu: 0.05% to 1.00%, Ni: 0.01% to 1.00%, Mg: 0.0005% to 0.0200%, Ca: 0.0005% to 0.0150%, Al: 0.0050% to 1.00%, Zr: 0.0001% to 0.2000%, P: 0.035% or less, and S: 0.035% or less; and a balance of Fe and inevitable impurities, wherein contents of Ti and V fulfill the following formula (1), and a rail head portion of the pearlitic steel rail has a pearlite structure, $$5 \leq [V(\%\text{ by mass})]/[Ti(\%\text{ by mass})] \leq 20 \quad \text{Formula (1).}$$

9. The method for manufacturing a pearlitic rail according to claim 2, wherein N is 0.0024 to 0.0039% in the bloom.

10. A method for manufacturing a pearlitic rail, the method comprising subjecting a bloom to hot rolling, wherein the bloom consists of: in terms of percent by mass, C: more than 0.85% to 1.40%;

Si: 0.10% to 2.00%;

Mn: 0.10% to 2.00%;

Ti: 0.003% to 0.01%;

V: 0.005% to 0.20%;

N: 0.0024 to less than 0.0040%;

one or more selected from the group consisting of Nb: 0.002% to 0.050%, Cr: 0.05% to 2.00%, Mo: 0.01% to 0.50%, Co: 0.10% to 2.00%, Cu: 0.05% to 1.00%, Ni: 0.01% to 1.00%, Mg: 0.0005% to 0.0200%, Ca: 0.0005% to 0.0150%, Al: 0.0050% to 1.00%, Zr: 0.0001% to 0.2000%, P: 0.035% or less, and S: 0.035% or less; and a balance of Fe and inevitable impurities, wherein contents of Ti and V fulfill the following formula (1), and finishing rolling of the hot rolling is carried out under conditions where a finishing rolling temperature FT in terms of ° C. is set to be in a range represented by the following formula (3), wherein $T_c$ is represented by the following formula (2) in which [C] is the content of C in terms of % by mass, [V] is the content of V in terms of % by mass, and [Ti] is the content of Ti in terms of % by mass of the bloom, $$5 \leq [V(\%\text{ by mass})]/[Ti(\%\text{ by mass})] \leq 20 \quad \text{Formula (1)}$$

$$T_c = 850 + 35 \times [C] + 1.35 \times 10^4 \times [Ti] + 180 \times [V] \quad \text{Formula (2)}$$

$$T_c - 25 \leq FT \leq T_c + 25 \quad \text{Formula (3).}$$

11. The pearlitic steel rail according to claim 8, wherein an average grain diameter of Ti-based precipitates, V-based precipitates, or Ti—V complex precipitates is in a range of 10 nm to 100 nm.

12. The pearlitic steel rail according to claim 8, wherein a density of Ti-based precipitates, V-based precipitates, or Ti—V complex precipitates is in a range of 50,000 precipitates to 500,000 precipitates per 1 $mm^2$.

13. The pearlitic steel rail according to claim 11, wherein a density of Ti-based precipitates, V-based precipitates, or Ti—V complex precipitates is in a range of 50,000 precipitates to 500,000 precipitates per 1 $mm^2$.

14. The pearlitic steel rail according to claim 8, wherein N is 0.0024 to 0.0039%.

15. The method for manufacturing a pearlitic rail according to claim 10, wherein the finishing rolling is carried out under conditions where a sum FR in terms of % of reductions of cross-sectional area in last two passes is set to be in a range represented by the following formula (5), wherein $R_c$ is represented by the following formula (4) in which [C] is the content of C in terms of % by mass, [V] is the content of V in terms of % by mass, and [Ti] is the content of Ti in terms of % by mass of the bloom, $$R_c = 35 - 13 \times [C] - 600 \times [Ti] - 20 \times [V] \quad \text{Formula (4)}$$

$$R_c - 5 \leq FR \leq R_c + 5 \quad \text{Formula (5).}$$

16. The method for manufacturing a pearlitic rail according to claim 10, wherein N is 0.0024 to 0.0039% in the bloom.

* * * * *

UNITED STATES PATENT AND TRADEMARK OFFICE

CERTIFICATE OF CORRECTION

PATENT NO. : 8,747,576 B2
APPLICATION NO. : 13/261069
DATED : June 10, 2014
INVENTOR(S) : Teruhisa Miyazaki et al.

It is certified that error appears in the above-identified patent and that said Letters Patent is hereby corrected as shown below:

In the Specification

Column 13, line 31, change "exceeds TC+25" to -- exceeds $T_c$+25 --;

Column 15, line 17, change "cross-sectional area s" to -- cross-sectional areas --;

Column 15, lines 48-49, change "$R_c$-5≤FR≤+$R_c$5" to -- $R_c$-5≤FR≤$R_c$+5 --;

In the Claims

Column 23, line 64, change "and N:0.0024 to less than 0.0040%" to

-- N:0.0024 to less than 0.0040% --;

Column 24, lines 36-37, change "wherein R, is represented by" to -- wherein $R_c$ is represented by --.

Signed and Sealed this
Sixth Day of January, 2015

Michelle K. Lee

Michelle K. Lee
*Deputy Director of the United States Patent and Trademark Office*